United States Patent [19]

Mitsui et al.

[11] Patent Number: 4,959,298

[45] Date of Patent: Sep. 25, 1990

[54] SILVER HALIDE COLOR PHOTOGRAPHIC MATERIAL

[75] Inventors: Akio Mitsui; Takashi Ozawa, both of Minami Ashigara, Japan

[73] Assignee: Fuji Photo Film Co., Ltd., Kanagawa, Japan

[21] Appl. No.: 256,128

[22] Filed: Oct. 7, 1988

Related U.S. Application Data

[63] Continuation of Ser. No. 915,585, Oct. 6, 1986, abandoned.

[30] Foreign Application Priority Data

Oct. 4, 1985 [JP] Japan ..... 60-221499
Jan. 8, 1986 [JP] Japan ..... 61-1866

[51] Int. Cl.[5] ..... G03C 7/38; G03C 7/392

[52] U.S. Cl. ..... 430/496; 430/551; 430/558; 430/611

[58] Field of Search ..... 430/611, 558, 551, 496

[56] References Cited

U.S. PATENT DOCUMENTS

| | | | |
|---|---|---|---|
| 4,448,878 | 5/1984 | Yamamuro et al. | 430/507 |
| 4,618,573 | 10/1986 | Okamura et al. | 430/558 |
| 4,629,640 | 12/1986 | Akao | 428/349 |
| 4,639,413 | 1/1987 | Kawasgishi et al. | 430/546 |

OTHER PUBLICATIONS

Furutachi et al., U.S. Statutory Invention Registration, H131 Published 9-2-86.

*Primary Examiner*—Paul R. Michl
*Assistant Examiner*—Lee C. Wright
*Attorney, Agent, or Firm*—Sughrue, Mion, Zinn, MacPeak & Seas

[57] ABSTRACT

A siliver halide color photographic material, comprising at least one of magenta couplers having the following general formula (I)

(I)

wherein $R^1$ represents a hydrogen atom or a substituent; X represents a hydrogen atom or a group that can be cleaved by the coupling reaction with the oxidation product of an aromatic primary amine developing agent; *Za*, *Zb* and *Zc* each represents a methine group, a substituted methine, =N—or —NH—; one of the *Za*—*Zb* bond and the *Zb*—*Zc* bond is a double bond and the other is a single bond; and *Zb*-*Zc* may be fused to an aromatic ring, the coupler may form a dimer or higher polymer via $R^1$ or X, and when *Za*, *Zb* or *Zc* is a substituted methine, the coupler may form a dimer or higher polymer through the substituted methine, and at least one of compounds having the following general formula (II):

(II)

wherein M represents a hydrogen atom, an alkali metal atom, a quaternary ammonium group or a group that can be cleaved under an alkaline condition; and $R_2$ and $R_3$ that may or may not be the same each represents a hydrogen atom, a substituted or unsubstituted aliphatic hydrocarbon group, or a substituted or unsubstituted aromatic hydrocarbon group, or $R_2$ and $R_3$ may form together a ring.

10 Claims, No Drawings

SILVER HALIDE COLOR PHOTOGRAPHIC MATERIAL

This is a continuation of application Ser. No. 06/915,585, filed Oct. 6, 1986 now abandoned.

FIELD OF THE INVENTION

The present invention relates to silver halide color photographic materials, and particularly, to silver halide color photographic materials which are excellent in color reproducibility and also excellentt in long-term storability.

BACKGROUND OF THE INVENTION

A silver halide color photographic material generally includes silver halide emulsion layers light-sensitive to the wavelengths corresponding to the three primary colors, that is, blue, green and red respectively, and capable of producing yellow, magenta and cyan hues respectively to form a colored image by the so-called subtractive process. The reproduced colored image will, therefore, depend greatly on the color sensitivity of each layer and the spectral absorption characteristics of the colors developed in the layers.

Generally, these characteristics have not always been their theoretical best due to restrictions such as the color developabilities of compounds used. Various improvements, however, have been made as to the color reproducibility of magenta couplers since the hue of the developed color of magenta couplers is important in view of the color reproducibility. Particularly, pyrazoloazole type magenta couplers are excellent in spectral absorption characteristics of the hue of the developed color.

For example, to improve the hue of the developed color of magenta couplers, anilino-type magenta couplers (see Japanese Patent Application (OPI) Nos. 74027/74, 111631/74, etc.) (the term "OPI" as used herein refers to a "published unexamined Japanese patent application) that are considered 5-pyrazolone-types and show better results with respect to spectral absorption characteristics than when ureido-type magenta couplers and acylamino-type magenta couplers are developed. Further, pyrazolotriazole-type magenta couplers, as described in U.S. Pat. No. 3,725,067, that are low in undesirable subabsorption are also developed. Couplers of this type are low in undesirable absorption in the blue light wavelength region and the red light wavelength region, are advantageous in color reproducibility, are stable to light, heatt and humidity and upon color development result in excellentt obtained images which are less yellowed. This phenomenon is probably due to the fact that the couplers themselves negligibly decompose, in comparison to the dye images obtained when 5-pyrazolone-type magenta couplers are used. On the other hand, the pyrazoloazole type magenta couplers are disadvantageous in comparison to the 5-pyrazolone type magenta couplers in that when the photosensitive materials are stored for a long period of time before their use, the sensitivity is undesirably lowered and fogging of the emulsion would result.

Known methods of preventing undesirable changes in photographic performance observed during the storage or developing treatment from occurring, particularly of preventing fog from occurring, include the addition into photosensitive materials or treating liquids, heterocyclic compounds such as 1-phenyl-5-mercaptotetrazole as disclosed in Belgian Patent 671,402, U.S. Pat. Nos. 3,295,976, 3,376,310, 3,615,616, 3,071,465, 3,420,664 and 2,403,927, Japanese Patent Application (OPI) Nos. 37436/75 and 95728/83, etc., benzotriazoles as disclosed in British Patents 919,061 and 768,438, U.S. Pat. Nos. 3,157,509 and 3,082,088, German Patent 617,712, etc., benzimidazoles as disclosed in U.S. Pat. Nos. 3,137,578, 3,148,066 and 3,511,663, British Patents 271,475, 1,344,548, 3,148,066 and 3,511,663, German Patents 708,424, 635,769 and 2,205,539, etc. and imidazoles as disclosed in U.S. Pat. Nos. 3,106,467, 3,420,670, 1,763,990, 2,271,229, etc.

However, if only these compounds are used, the effect of preventing formation of fog during the storage of pyrazoloazole couplers from increasing is not sufficient, or even if this effect is sufficient, the sensitivity is lowered or other disadvantages are observed. Although other various compounds have been studied, compounds that can satisfactorily prevent the formation of fog from increasing during storage without lowering the sensitivity have not been found hitherto.

Although the present inventors have suggested using benzothiazole compounds in Japanese Patent Application (OPI) No. 94918/75 and tetrazole compounds in Japanese Patent Application (OPI) No. 95728/83, the effect of these compounds for preventing fog from increasing, particularly after storage, without at the same time lowering the sensitivity is insufficient.

SUMMARY OF THE INVENTION

Thus, an object of the present invention is to provide silver halide color photographic materials that have the above-described advantages of pyrazoloazole type magenta couplers and are also improved in their long-term storability.

Another object of the present invention is to provide silver halide color photographic materials which are excellent in color reproducibility by giving magenta color images superior in spectral absorption characteristics.

Still another object of the present invention is to provide color photographic materials which develop color images that are fast to light and are improved to avoid the occurrence of white stain.

A further object of the present invention is to provide silver halide color photographic materials whose sensitivity and developed color density will not lower substantially if they are stored for a long period of time.

A still further objects of the present invention will become more apparent from the following detailed description of the invention.

As a result of earnest study to develop silver halide color photographic materials that can attain the above objects, the present inventors have found that silver halide color photographic materials containing a mercaptotetrazole type compound together with a pyrazoloazole type magenta coupler are superior over these prior deficient material. It has also been found that when the photographic materials are stored at a relative humidity of up to 65%, the effect is also superior. The present invention has been based on these findings.

These objects have been attained by providing a silver halide color photographic material comprising a support having coating thereon at least one silver halide emulsion layer, and at least one magenta coupler having the following general formula (I):

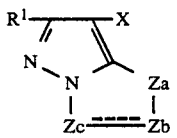

(I)

wherein $R^1$ represents a hydrogen atom or a substituent; X represents a hydrogen atom or a group capable of releasing from the coupler upon a coupling reaction with the oxidation product of an aromatic primary amine developing agent; Za, Zb and Zc each represents a methine group, a substituted methine group, =N— or —NH—; one of the Za–Zb bond and the Zb–Zc bond is a double bond while the other is a single bond; and Zb–Zc may be fused to an aromatic ring, the coupler may form a dimer or higher polymer by linking at the $R^1$ or X position, and when Za, Zb or Zc is a substituted methine group, the coupler may form a dimer or higher polymer through the substituted methine group. and at least one compound having the following general formula (II):

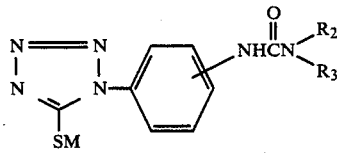

(II)

wherein M represents a hydrogen atom, an alkali metal atom, a quaternary ammonium group or a group that is capable of being cleaved under alkaline conditions, and $R_2$ and $R_3$, which may be the same as or different from each other, represent a hydrogen atom, a substituted or unsubstituted aliphatic hydrocarbon group, or a substituted or unsubstituted aromatic hydrocarbon group, or $R_2$ and $R_3$ may form together a ring.

The silver halide color photographic material is more preferably in the form of a packaged product where the relative humidity therein may be up to 65%.

These above-mentioned compounds represented by general formulae (I) and (II) used in the present invention are described in detail below.

Polymers of the general formula (I) have two or more groups represented by the general formula (I) per molecule, including a bis-form and polymeer couplers. The polymer coupler may be a homopolymer consisting only of a monomer having the configuration represented by the general formula (I), preferably a monomer having a vinyl group (hereinafter referred to as a vinyl monomer), or the polymer coupler may form a copolymer with a non-color developing ethylenic monomer that will not couple with the oxidation product of an aromatic primary amine developing agent.

Preferred pyrazoloazole type magenta couplers represented by the general formula (I) represented by the following formulae (III), (IV), (V), (VI), (VII), (VIII) and (IX):

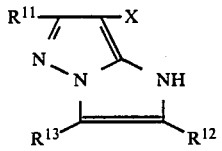

(III)

-continued

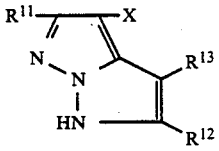

(IV)

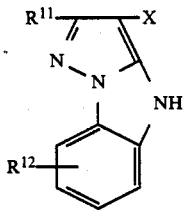

(V)

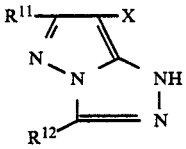

(VI)

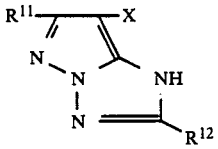

(VII)

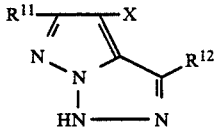

(VIII)

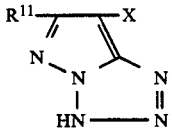

(IX)

Of the couplers represented by general formulae (III)—(IX), those more preferable in view of the objects of the present invention are represented by general formulae (III), (VI) and (VII), and most preferred are those represented by the general formula (VII).

In general formulae (III)-(IX), $R^{11}$, $R^{12}$ and $R^{13}$ may be the same or different from each other and each may represent a hydrogen atom, a halogen atom, an alkyl group, an aryl group, a heterocyclic group, a cyano group, an alkoxy cyano group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoyl amino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom, a halogen atom, a carboxyl group, or a group bonded to the carbon atom at the coupling position via an oxygen atom, a nitrogen atom or a sulfur atom and is capable of being released upon a coupling reaction, and $R^{11}$, $R^{12}$, $R^{13}$ and X may also be a divalent group to constitute a bis-form.

The coupler residue represented by general formulae (III)–(IX) may be in the form of a polymer coupler where the coupler residue is present in the main chain of the polymer or a branched chain, and particularly polymers derived from vinyl monomers having the chemical structure represented by general formulae (III)–(IX) wherein $R^{11}$, $R^{12}$, $R^{13}$ and X represent a vinyl group or a connecting group are preferred.

More specifically, $R^{11}$, $R^{12}$ and $R^{13}$ may each represent a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, an aryl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecaneamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy groups, etc.), an acyloxy group (e.g., an acetoxy group, a hexadecanoyloxy group, etc.), a carbamoyloxy group (e.g., an N-phenylcarbamoyloxy group, an N-ethylcarbamoyl group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecaneamido group, an α-(2,4-di-t-amylphenoxy)butylamido group, a γ-(3-t-butyl-4-hydroxyphenoxy)butylamido group, an α-{4-(4-hydroxyphenyl-sulfonyl)phenoxy}decaneamido group, etc.), an anilino group (e.g., a phenoxyamino group, a 2-chloroanilino group, a 2-chloro-5-tetradecaneamidoanilino group, a 2-chloro-5-dodecyloxycarbonylanilino group, an N-acetylanilino group, a 2-chloro-5-{α-(3-t-butyl-4-hydroxyphenoxy)dodecneamido}anilino group, etc.), an ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxylphenylthio group, a 4-tetradecaneamidophenylthio group, etc.), a heterocyclic thio group (e.g., a 2-benzothiazoylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarboxylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-{3-(2,4-di-tert-amylphenoxy)propyl}-carbamoyl group, etc.), an acyl group (e.g., an acetyl group, a (2,4-di-tert-aminophenoxy)acetyl group, a benzoyl group, etc.), a sulfamoyl group (e.g., an N-ethylsulfamoyl group, an N-N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methylsulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.), or an aryloxycarbonyl group (e.g., a phenyloxycarbonyl group, a 3-pentadecyloxycarbonyl group, etc.); and X represents a hydrogen atom, a halogen atom (e.g., a chlorine atom, a bromine atom, an iodine atom, etc.), a carboxyl group, a group connected through an oxygen atom (e.g., an acetoxy group, a propanoyloxy group, a benzoyloxy group, a 2,4-dichlorobenzoyloxy group, an ethoxyoxazoyloxy group, a pyruvinyl group, a cinnamoyloxy group, a phenoxy group, a 4-cyanophenoxy group, a 4-methanesulfoneamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenetyloxy group, a 2-phenoxyethoxy group, a 5-phenyltetrazolyloxy group, a 2-benzothiazolyloxy group, etc.), a group connected through a nitrogen atom (e.g., a benzenesulfonamido group, an N-ethyltoluenesulfonamido group, a heptafluorobutaneamido group, a 2,3,4,5,6-pentafluorobenzeamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-ethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazole-1-yl group, a 5- or 6-bromo-benzotriazole-1-yl group, a 5-methyl-1,2,3,4-triazole-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.), an arylazo group (e.g., a 4-methoxyphenylazo group, a 4-pivaloylaminophenylazo group, a 2-naphthylazo group, a 3-methyl-4-hydroxyphenylazo group, etc.) or a group connected through a sulfur atom (e.g., a phenylthio group, a 2-carboxyphenylthio group, a 2-methoxy-5-t-octylphenylthio group, a 4-methanesulfonylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, or a 2-phenyl-3-dodecyl-1,2,4-triazolyl-5-thio group, etc.).

In the couplers represented by general formulae (III) and (IV), $R^{12}$ and $R^{13}$ may form together a 5- to 7-membered ring.

In the case where $R^{11}$, $R^{12}$, $R^{13}$ or X is a divalent group to form a bis-form, $R^{11}$, $R^{12}$ and $R^{13}$ are preferably a substituted or unsubstituted alkylene group (e.g., a methylene group, an ethylene group, a 1,10-decylene group, $-CH_2CH_2-O-CH_2-CH_2-$, etc.), a substituted or unsubstituted phenylene group (e.g., a 1,4-phenylene group, a 1,3-phenylene group,

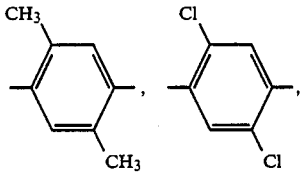

etc.), a $NHCO-R^{14}-CONH-$ group wherein $R^{14}$ represents a substituted or unsubstituted alkylene group or a phenylene group such as

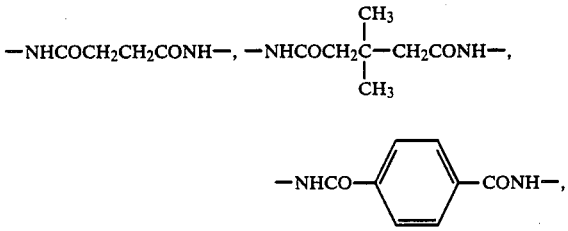

etc.) or a $-S-R^{14}-S-$ group wherein $R^{14}$ represents a substituted or unsubstituted alkylene group such as

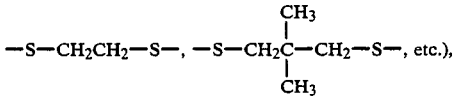

and X represents a divalent group selected from the groups mentioned above.

When the coupler residues represented by general formulae (III)-(IX) are included in a vinyl monomer, a connecting group represented by $R^{11}$, $R^{12}$, $R^{13}$ or X includes a moiety comprising a combination of groups selected from an alkylene group which may be substituted or unsubstituted (e.g., a methylene group, an ethylene group, a 1,10-decylene group, $-CH_2CH_2OCH_2CH_2-$, etc.), a phenylene group which may be substituted or unsubstituted (e.g., a 1,4-phenylene group, a 1,3-phenylene group, 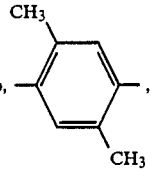

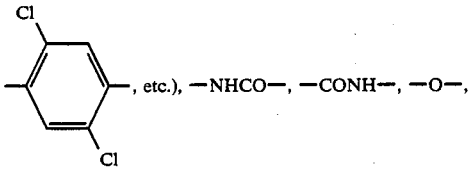

—OCO— and an aralkylene group (e.g.,

-continued

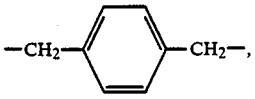

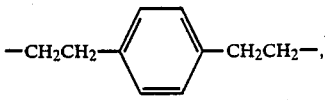

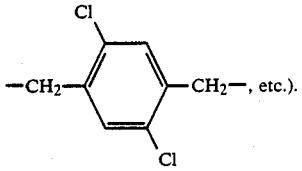

Preferred connecting groups are —NHCO—, $-CH_2CH_2-$,

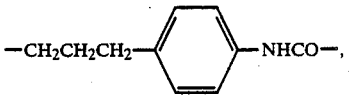

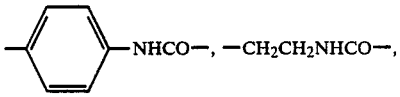

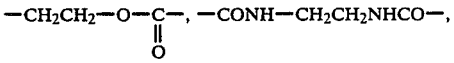

$-CH_2CH_2O-CH_2CH_2-NHCO-$ and

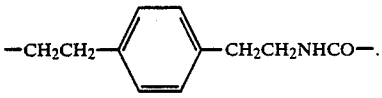

The vinyl group may also have a substituent other than the residues represented by general formulae (III)-(IX), and such a substituent is preferably a hydrogen atom, a chlorine atom or a lower alkyl group having 1 to 4 carbon atoms such as a methyl group and an ethyl group.

The monomer containing a coupler residue represented by general formulae (III)-(IX) may form a copolymer with a non-color developing ethylenic monomer that would not undergo a coupling reaction with the oxidation product of an aromatic primary amine developing agent.

Such non-color developing ethylenic monomers include acrylic acid, α-chloroacrylic acid, α-alkylacrylic acids (e.g., methacrylic acid, etc.), and esters and amides derived from these acrylic acids (e.g., acrylamide, n-butylacrylamide, t-butylacrylamide, diacetone acrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxymethacrylates), methylenedibisacrylamide, vinyl esters (e.g., vinyl acetate, vinyl propionate and vinyl laurate), acrylonitrile, methacrylonitrile, aromatic vinyl compounds (e.g., styrene and its derivatives, vinyl toluene, divinyl benzene, vinyl acetophenone and sulfostyrene), itaconic acid, citraconic acid, crotonic acid, vinylidene chloride, vinyl alkyl ethers (e.g., vinyl ethyl ether), maleic acid, maleic anhydride, maleate esters, N-vinyl-2-pyrrolidone, N-vinylpyridine, 2- and 4-vinylpyridines, etc. The non-color developing ethylenically unsaturated monomers used herein may comprise a mixture of these monomers such as combinations of n-butyl acrylate and methyl acrylate, styrene and methacrylic acid, methacrylic acid and acrylamide, or methyl acrylate and diacetone acrylamide.

As is well known to those of ordinary skill in the field of polymer color couplers, a non-color developing ethylenically unsaturated monomer to be copolymerized with a solid water-insoluble monomer coupler may be selected such that the physical properties and/or chemical properties of the copolymer (e.g., solubility, compatibility with a binder of the photographic colloid composition such as gelatin, flexibility, heat stability, etc.) may be favorably affected.

Polymer couplers used in the present invention may be water-soluble or water-insoluble, and preferably are polymer coupler latexes.

Specific examples of typical magenta couplers and their vinyl monomers are shown below; however, the present invention is not limited to the use of these examplary couplers and vinyl monomers containing them.

M-1

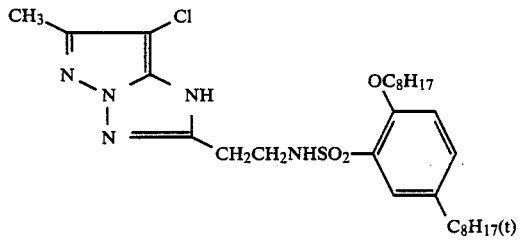

M-2

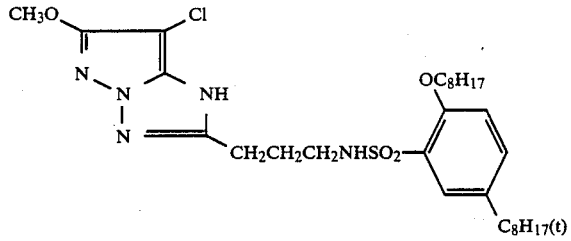

M-3

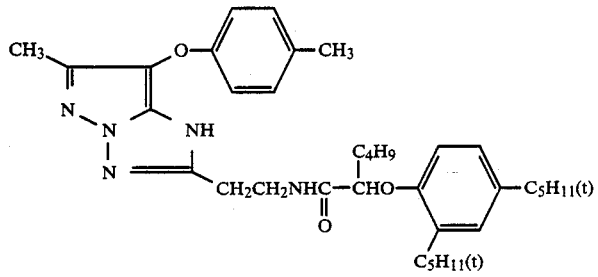

M-4

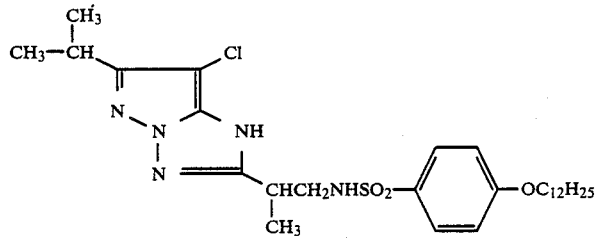

M-5

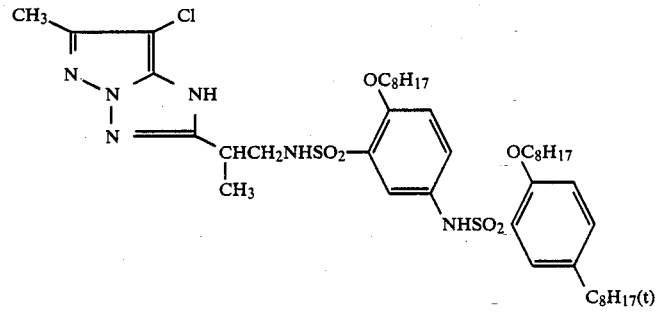

-continued
M-6
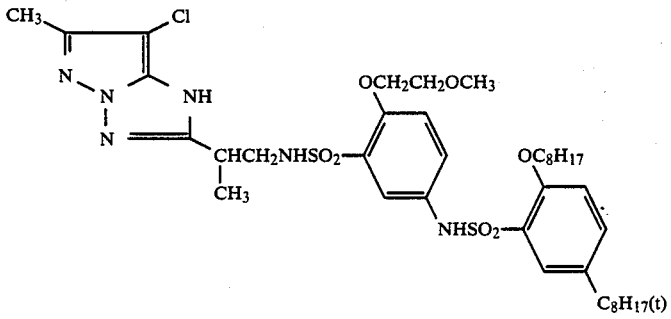
M-7
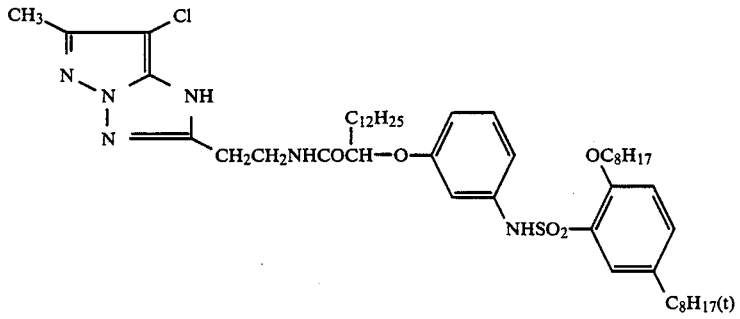
M-8
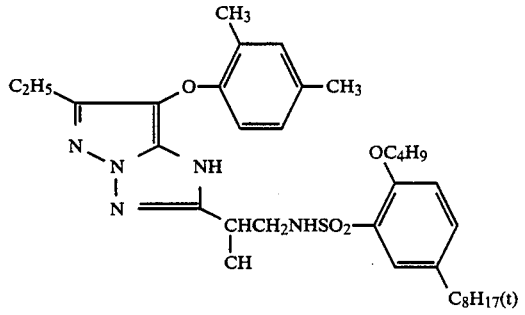
M-9
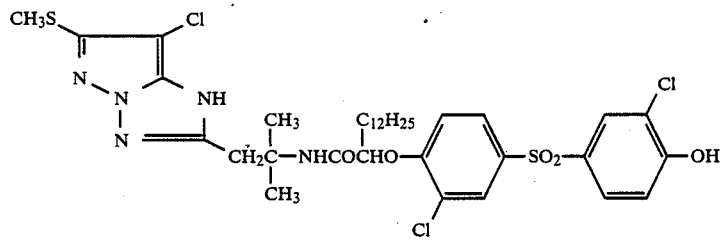
M-10
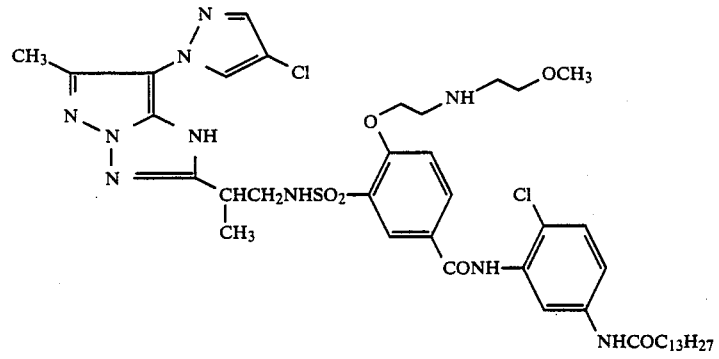

-continued
M-11
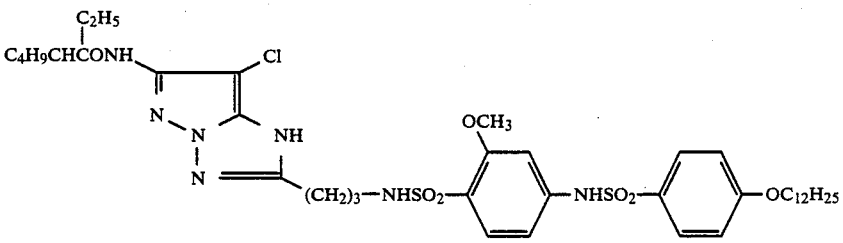
M-12
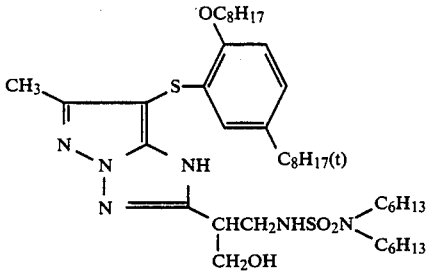
M-13
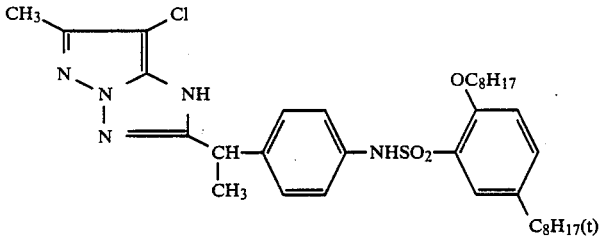
M-14
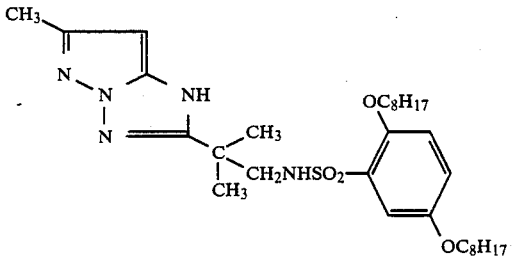
M-15
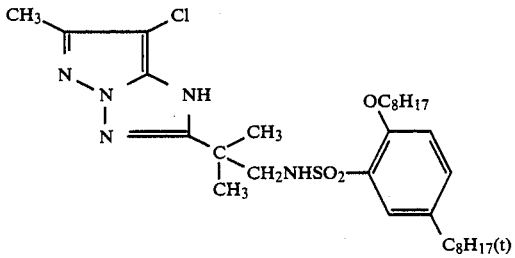
M-16
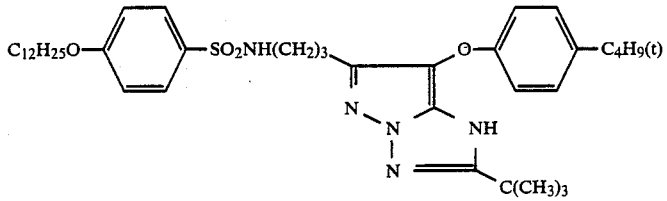

-continued
M-17
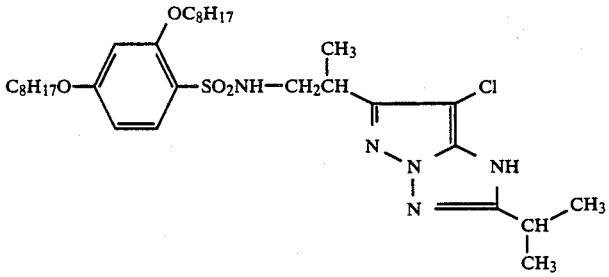
M-18
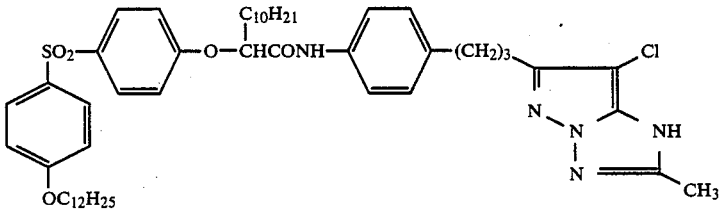
M-19
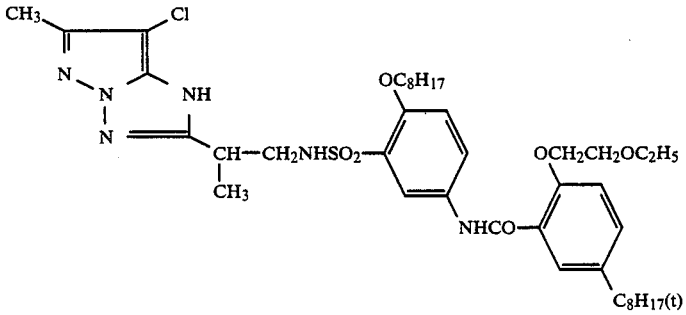
M-20
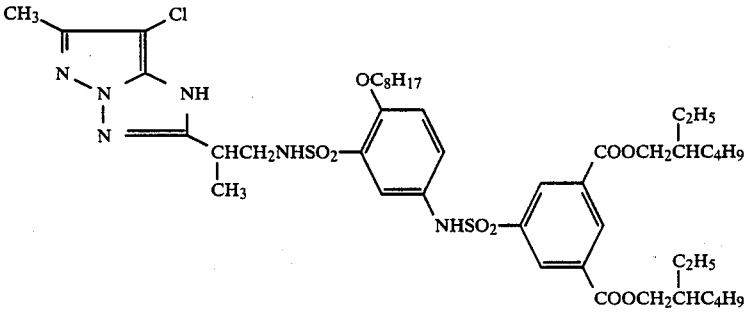
M-21
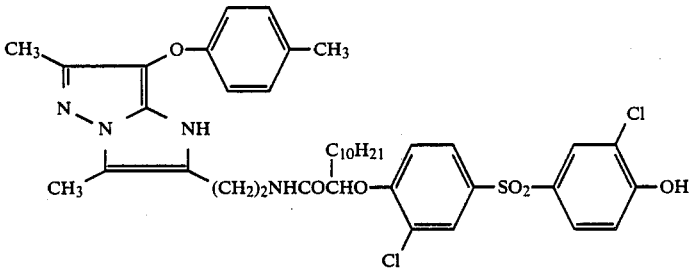

-continued
M-22
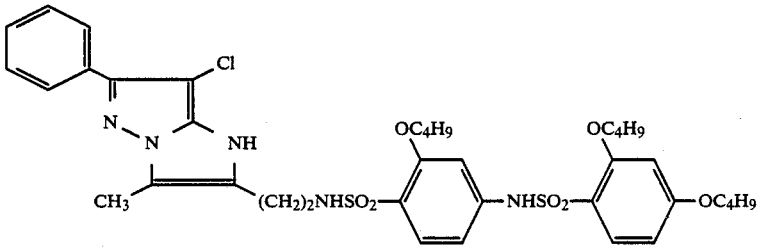
M-23
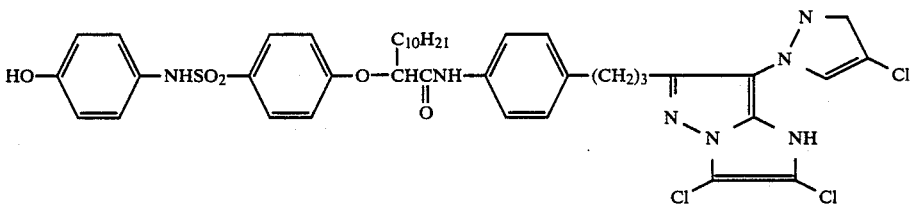
M-24
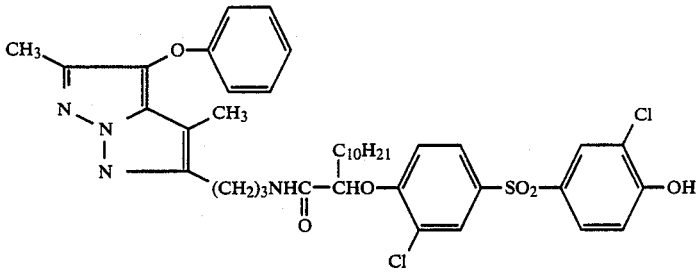
M-25
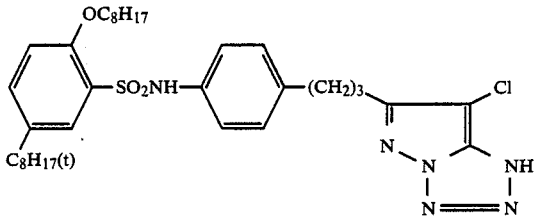
M-26
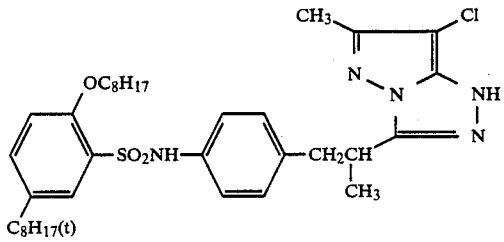
M-27
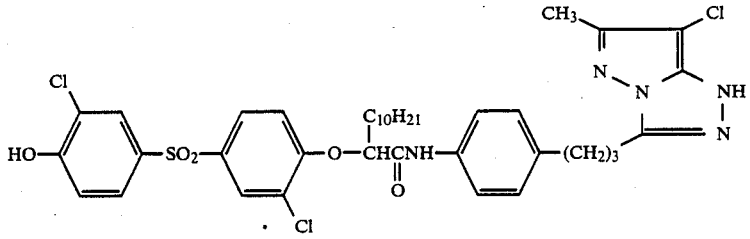

-continued

M-28

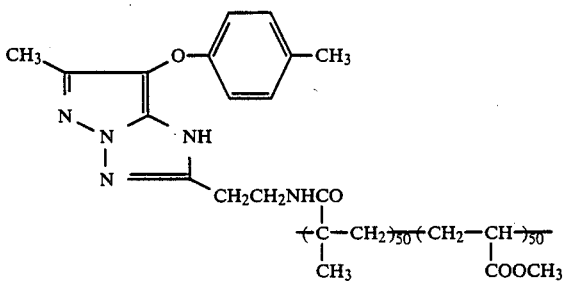

M-29

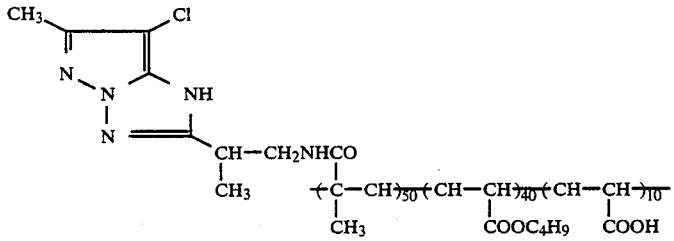

M-30

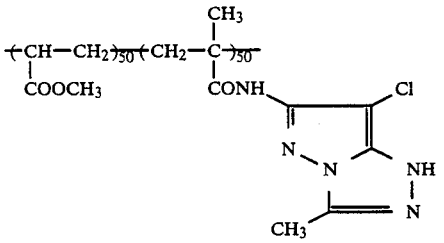

M-31

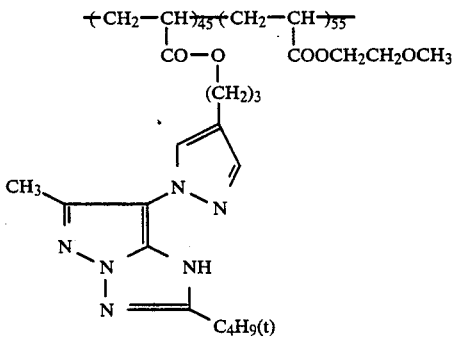

M-32

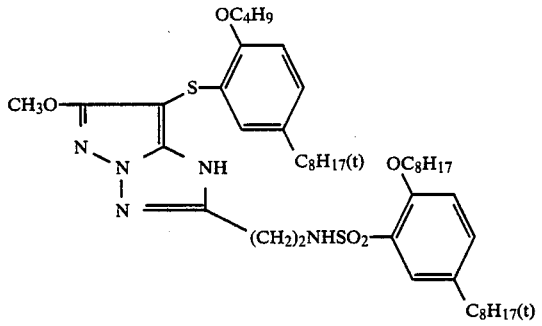

Examples and synthesis of compounds represented by general formulae (III) to (IX) are disclosed in the following publications.

Compounds of general formula (III) are disclosed in U.S. Pat. No. 4,500,630, compounds of general formula (IV) are disclosed in Japanese Patent Application (OPI) No. 43659/85, compounds of general formula (V) are disclosed in U.S. Pat. No. 3,061,432, compounds of general formula (VI) are disclosed in U.S. Pat. No. 3,725,067, compounds of general formula (VII) are disclosed in U.S. Pat. No. 4,540,654, compounds of general formula (VIII) are disclosed in Research Disclosure, RD No. 24626 (October 1984), and compounds of general formula (IX) are disclosed in Japanese Patent Application (OPI) No. 33552/85.

High color developing ballast groups disclosed in Japanese Patent Application (OPI) Nos. 42045/83, 177553/84, 174836/84, 177554/84, 177557/84, 177556/84 and 177555/84, etc., may be applied to any of compounds of the general formulae (III) to (IX).

In general formula (II), M preferably represents a hydrogen atom, an alkali metal atom such as $Li^+$, $Na^+$ or $K^+$; a quaternary ammonium group such as $H_4N$, $(CH_3)_4N^+$, $(C_4H_9)_4N^+$, n—$C_{12}H_{25}(CH_3)_3N^+$, n—$C_{16}H_{33}(CH_3)_3N^+$, $PhCH_2(CH_3)_3N^+$, etc., or a group that can split off under alkaline conditions such as —COR′, —$CO_2$R′, —$CH_2CH_2CN$, —$CH_2CH_2SO_2$R′ or —$CO_2H$ wherein R′ represents an alkyl group or an aryl group.

$R_2$ and $R_3$ each preferably represents a hydrogen atom, a substituted or unsubstituted aliphatic hydrocarbon group such as an alkyl group having up to 18 carbon atoms, a cycloalkyl group or an alkenyl group (e.g., a methyl group, an ethyl group, an n-propyl group, an n-butyl group, a t-butyl group, an n-pentyl group, an n-hexyl group, a cyclohexyl group, an n-octyl group, an n-dodecyl group, an n-octadecyl group, an aryl group, etc), a substituted or unsubstituted aromatic hydrocarbon group (e.g., an aryl group having 6 to 30 carbon atoms, for example, a phenyl group, a naphthyl group, etc.).

When $R_2$ and $R_3$ together form a ring, the ring preferably contains 2 to 6 carbon atoms and may contain O, N and S in the ring such as —$(CH_2)_4$—, —$(CH_2)_5$—, —$(CH_2)_6$—, $$-CH_2CH_2OCH_2CH_2-,\ -CH_2CH_2\overset{\overset{CH_3}{|}}{N}CH_2CH_2-,\ \text{etc.}$$

When $R_2$ and $R_3$ are substituted, the substituent may be an alkoxy group (e.g., an ethoxy group, a methoxy group, etc.), a halogen atom (e.g., a chlorine atom, a bromine atom, etc.), an alkyl group (e.g., a methyl group, an ethyl group, etc.), a phenyl group, an alkoxycarbonyl group (e.g., an ethoxycarbonyl group, etc.), an acyl group (e.g., an acetyl group, etc.), an acyloxy group (e.g., an acetyloxy group, etc.), a cyano group, a nitro group, an alkylthio group (e.g., a methylthio group, etc.), an amide group (e.g., an acetamido group, etc.), a sulfonamido group (e.g., a methanesulfonamido group, etc.), etc.

$R_2$ and $R_3$ are especially preferred to be a hydrogen atom, an alkyl group having 1 to 6 carbon atoms, a phenyl group, and more particularly, a hydrogen atom, a methyl group, an ethyl group, an n-propyl group, an n-butyl group or an n-pentyl group.

$R_2$ and $R_3$ may be the same or different.

Examples of compounds represented by general formula (II) preferably used in the present invention are:

II-1

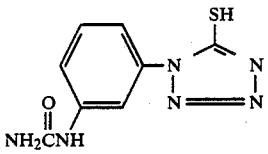

-continued

II-2

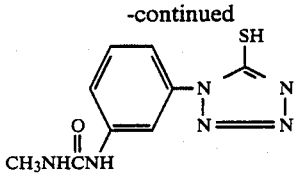

II-3

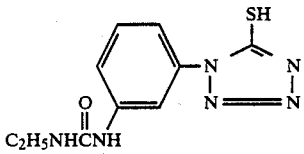

II-4

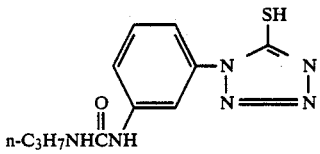

II-5

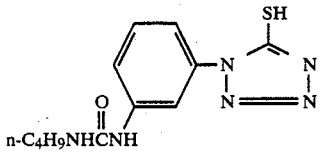

II-6

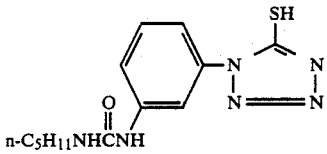

II-7

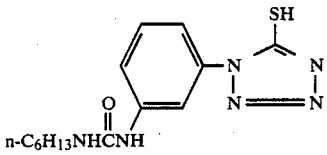

II-8

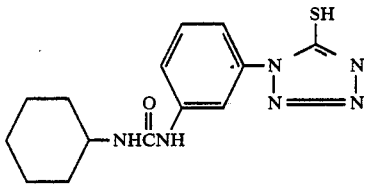

II-9

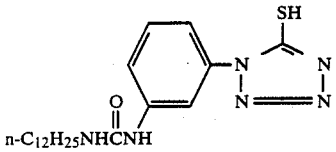

II-10

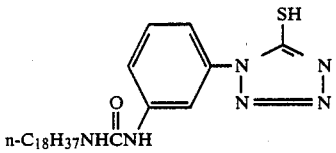

II-11

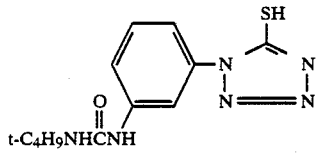

-continued
II-12
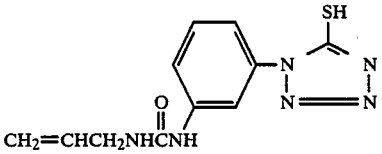
II-13
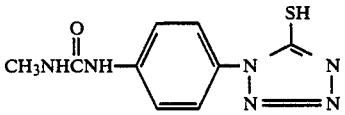
II-14
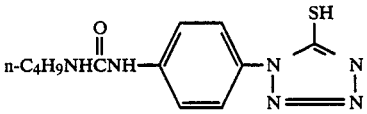
II-15
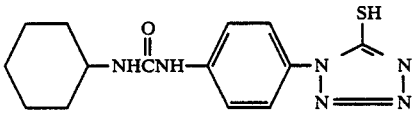
II-16
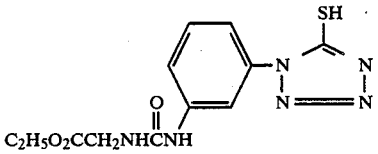
II-17
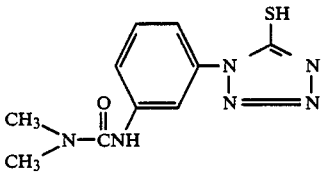
II-18
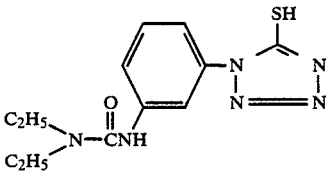
II-19
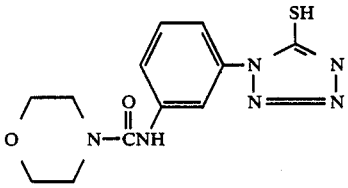
II-20
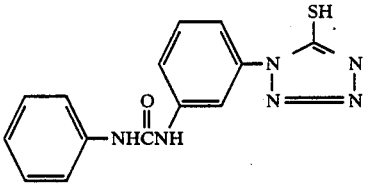
II-21
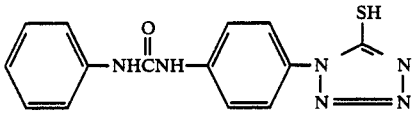
-continued
II-22
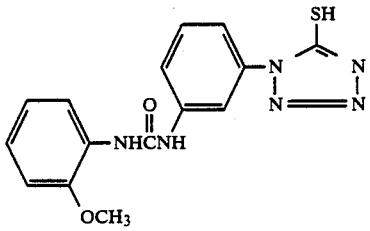
II-23
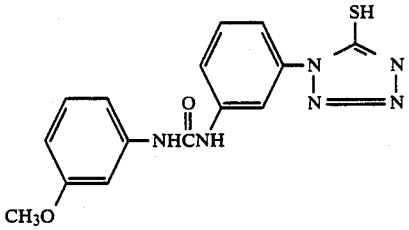
II-24
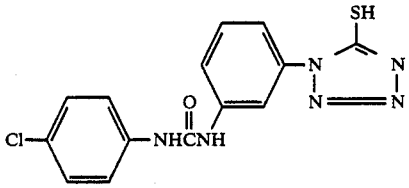
II-25
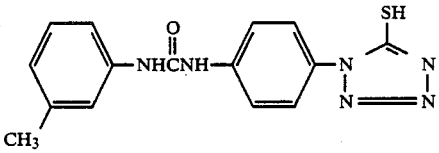
II-26
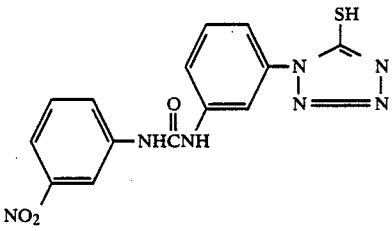
II-27
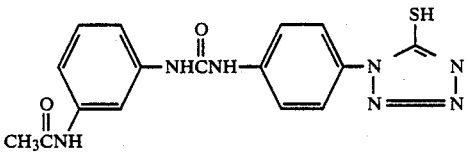
II-28
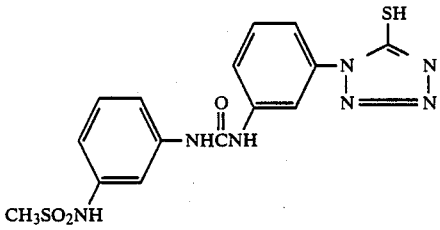
II-29
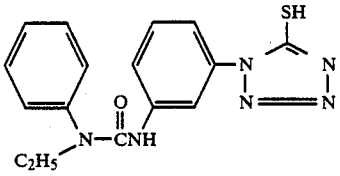

-continued

II-30

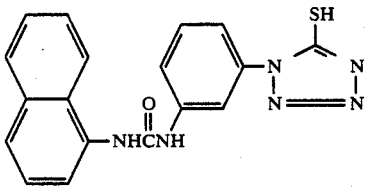

II-31

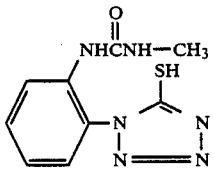

II-32

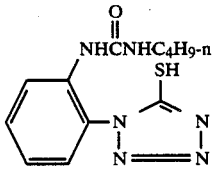

Compounds of general formula (II) may be easily prepared according to the process disclosed in U.S. Pat. No. 4,448,878.

Desirable embodiments of the present invention are described below.

The magenta couplers of general formula (I) used in the present invention are preferably added to a photosensitive silver halide emulsion layer in an amount of $1\times10^{-3}$ mol to $5\times10^{-1}$ mol, preferably $1\times10^{-2}$ to $5\times10^{-1}$ mol per mol of silver halide.

Although the compound (II) may be added in any of the layers of the photosensitive material, the compound (II) is desirably added in the layer containing the magenta coupler represented by general formula (I), or a layer next to the layer containing the magenta coupler (I).

The desirable amount of the compound (II) is in the range of about $10^{-7}$ to about $10^{-1}$ mol and more desirably $10^{-5}$ to $10^{-2}$ mol per mol of silver halide.

The relative humidity of the packed product embodying the present invention is 65% or below, preferably 58% or below. To keep the relative humidity at 65% or below, a sealed package is preferred.

The term "sealed package" refers to a moisture-proof package generally well known in the field of packaging. The packaging material used may comprise metal such as aluminium sheet, tin sheet and aluminium foil or composite laminate materials (that are known as so-called "laminate materials" in the field of packaging) of cellophane, paper, aluminium foil or the like with metal foils, glass, or various high molecular weight polymers such as polystyrenes, polyvinyl chlorides, polyvinylidene chlorides, polypropylenes, polycarbonates and polyamides.

Methods for sealing the package include an adhesive method that uses adhesives, the heat bonding method such as the heat sealing method, and other methods using cartridges which are generally used in the photographic field. Details of these methods are described in *Food Packaging Technique* Handbook, edited by Nihon Hoso Gijutsu Kyokai (Society of Packaging Technique in Japan), pages 573 to 609.

In the present invention, it is preferred to use cartridges made of high molecular weight polymers such as polyethylenes and polypropylenes for photographic photosensitive materials in the form of a roll and to use heat-sealed polyethylenes for photographic photosensitive materials.

The sealed package may also be in the form of double package.

Herein, the relative humidity according to the present invention should be measured at about 25° C. in a conventional manner. For example, part of a heat-sealed package is first heated and melted, then an electrical resistance hygrometer (e.g., a Hygrothermograph AR-33 YB Type available from KK. Ace Kenkyusho) is inserted into the package followed by sealing the package, and the relative humidity in the package is measured with the temperature of the package kept at about 25° C.

In a method of packaging where the humidity is lowered as in the present invention, the silver halide photosensitive material may be packaged in a low-humidity room, may be dried more than usual when the silver halide photosensitive material is dried, or may be sealed together with a drying agent such as silica gel to lower the humidity.

When the materials of the present invention are used, static trouble sometimes occurs due to lowering the humidity. To prevent such static trouble, it is preferred to add a fluorine type compound, well known as antistatic agents. Examples of fluorine type compounds which can be used include those compounds described, for example, in Japanese Patent Publication No. 43130/73, and Japanese Patent Application (OPI) Nos. 7781/71 and 55052/80.

To further prevent such static trouble, it is preferable to incorporate a matting agent in the outermost layer. Any known matting agent can be used such as silicon dioxide, titanium dioxide, magnesium dioxide, aluminium dioxide, barium sulfate, calcium carbonate, polymers and esters of acrylic acid and methacrylic acid, polyvinyl resins, polycarbonates and polymers and copolymers of styrene. The average particle diameter of the matting agent is preferably about 0.05 μm to about 10 μm. The amount of the matting agent to be added is preferably about 1 to about 300 mg/m$^2$.

It is also preferred to incorporate an ultraviolet absorbing agent in an outer layer from the photosensitive silver halide emulsion layer. Untraviolet absorbing agents which can be used in the present invention include aryl group-substituted benzotriazole compounds (e.g., described in U.S. Pat. No. 3,533,794), benzophenone compounds (e.g., described in Japanese Patent Application (OPI) No. 2784/71), cinnamate compounds (e.g., described in U.S. Pat. Nos. 3,705,805 and 3,707,375), butadiene compounds (e.g., U.S. Pat. No. 4,045,229), or benzooxydol compounds (e.g., described in U.S. Pat. No. 3,700,455). Ultraviolet absorbing agents described in U.S. Pat. No. 3,499,762, and Japanese Patent Application (OPI) No. 48535/79 and polymerized ultraviolet absorbing agents described in Japanese Patent Application (OPI) Nos. 111942/83 and 178351/83 can also be used.

Any silver halide selected from silver bromide, silver bromoiodide, silver bromochloroiodide, silver chlorobromide and silver chloride can be used in the photographic emulsion layers of the photosensitive material used in the present invention.

The silver halide grains in the photographic emulsion may be what are generally known as regular crystal grains that are, for example, of a cubic, octahedral or tetradecahedral configuration, or may be irregular crystal grains that are, for example, spherical, crystal grains having a crystal defect such as a twin plane, or a composite of these shapes. A mixture of various crystal grains may also be used.

The grain diameter of silver halide may be about 0.1 micron or below, or the grains may have a diameter of projected area of about 10 microns. The silver halide photographic emulsion may be a monodisperse emulsion having a narrow distribution of the silver halide grains or a polydisperse emulsion having a wide distribution of the grains.

The silver halide photographic emulsion that can be used in the present invention can be produced in a known fashion, for example, in the manner described in "I. Emulsion Preparation and Types" in *Research Disclosure,* Vol. 176, RD No. 17643 (December 1978), pages 22 to 23 and *Research Disclosure,* Vol. 187, RD No. 18716 (November 1979), page 648.

The photographic emulsion used in the present invention can be prepared in any conventional manner, including those described in P. Glafkides in *Chimie et Physique Photographique,* published by Paul Montel, 1967, by G. F. Duffin in *Photographic Emulsion Chemistry,* Focal Press, 1966, or by V. L. Zelikman, et al, *Making and Coating Photographic Emulsion,* Focal Press, 1964. That is, the photographic emulsion can be prepared by an acid method, a neutral method, an ammonium method, etc., and the reaction of a soluble silver salt with a soluble halide can be effected by the single-jet method, the double-jet method or a combination of these methods. A method where the grains are formed in the excess presence of silver ions, that is, the so-called reverse mixing method, can also be used. One specific type of the double-jet method, the so-called controlled double-jet method where the pAg in the liquid phase in which a silver halide will be formed is kept constant, can also be used. According to the last-mentioned method, a silver halide emulsion where the crystal form is regular and the grain size is almost uniform can be obtained.

Physical ripening of the grains in the presence of a known silver halide solvent (e.g., ammonium, potassium thiocyanate, thion compounds and thioethers described, for example, in U.S. Pat. No. 3,271,157, Japanese Patent Application (OPI) Nos. 12360/76, 82408/78, 144319/78, 100717/79 and 155828/79, etc.) can also be carried out, if desired. Also, by employing this method, a silver halide emulsion wherein the crystal form is regular and the grain size distribution is almost uniform can be obtained.

The silver halide emulsion consisting of regular crystals mentioned above can be obtained by controlling the pAg and the pH during the formation of the grains. Details regarding this method are described, for example, in *Photographic Science and Engineering,* Vol. 6, pages 159–165 (1962); *Journal of Photographic Science,* Vol. 12, pages 242–251 (1964); and U.S. Pat. No. 3,655,394 and British Patent No. 1,413,748.

Typical monodisperse emulsions are emulsions wherein the silver halide grains have an average grain diameter of about 0.1 micron or more and at least about 95% by weight of the grains are within the average grain diameter ±40%. Emulsions wherein the average grain diameter is about 0.25 to about 2 microns, and at least about 95% by weight of silver halide grains or at least about 95% by number of silver halide grains are in the range of the average grain diameter ±20% can be used in the present invention. Methods of producing such emulsions are described, for example, in U.S. Pat. Nos. 3,574,628 and 3,655,394 and British Patent No. 1,413,748. Monodisperse emulsions as described in Japanese Patent Application (OPI) Nos. 8600/73, 39027/76, 83097/76, 137133/78, 48521/79, 99419/79, 37635/83, 49938/83, etc. can also be preferred to be used in the present invention.

Further, tabular grains having an aspect ratio of 5 or more can also be used in the present invention. Tabular grains can easily be prepared by methods described, for example, by Gutoff in *Photographic Science and Engineering,* Vol. 14, pages 248–257 (1970), and in U.S. Pat. Nos. 4,434,226, 4,414,310, 4,433,048 and 4,439,520, British Patent No. 2,112,157, etc. When tabular grains are used, the covering power will be increased, the color sensitization efficiency will be increased due to the sensitizing dye, and other advantages can be attained, which are described in detail in U.S. Pat. No. 4,434,262 mentioned above.

The crystal structure may be uniform, or the inner part and the outer part thereof may have different halogen compositions, or the crystal structure may be a layer structure. Emulsion grains having such crystal structures are disclosed in British Patent No. 1,027,146, U.S. Pat. Nos. 3,505,068 and 4,444,877, Japanese Patent Application (OPI) No. 143331/85, etc. Silver halides having different compositions may be joined epitaxially, or silver halides may also be joined to compounds other than silver halides such as silver thiocyanate or lead oxide. Emulsion grains having this type of crystal structure are disclosed in U.S. Pat. Nos. 4,094,684, 4,142,900 and 4,459,353, British Patent No. 2,038,792, U.S. Pat. Nos. 4,349,622, 4,395,478, 4,433,501, 4,463,087, 3,656,962 and 3,852,067, Japanese Patent Application (OPI) No. 162540/84. In the course of the formation of silver halide grains or the physical ripening thereof, cadmium salts, zinc salts, lead salts, thallium salts, iridium salts or their complex salts, rhodium salts or their complex salts, or iron salts or iron complex salts may also be present.

These various emulsions may be of the surface latent image-type that will form a latent image mainly on the surface of the grains or the inner latent image-type that will form a latent image in the interior of the grains.

To remove the soluble silver salts from the emulsion before or after the physical ripening of the grains, the Nudel water washing method, the flocculation sedimentation method or the ultrafiltration method may be employed.

The emulsion used in the present invention is one that has generally been subjected to physical ripening, chemical ripening and spectral sensitization. Additives used in these steps are described in *Research Disclosure,* RD No. 17643 (December 1978), cited above and *Research Disclosure,* RD No. 18716 (November 1979), cited above, and the relevant parts thereof are summarized in Table 1 below.

Other known additives for silver halide color photographic materials that can be used in the present invention are described in the Research Disclosure references cited above, and the relevant parts are shown in Table 1 below.

TABLE 1

| Additives | RD 17643 | RD 18716 |
|---|---|---|
| 1. Chemical Sensitizers | Page 23 | Page 648, right column |
| 2. Sensitivity Increasers | | Page 648, right column |
| 3. Spectral Sensitizers and Supersensitizers | Pages 23 to 24 | Page 648, right column to Page 649, right column |
| 4. Brightners | Page 24 | |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to Page 650, left column |
| 7. Stain Preventives | Page 25, right column | Page 650, left column to right column |
| 8. Dye Image Stabilizers | Page 25 | |
| 9. Hardening Agents | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Static Preventives | Page 27 | Page 650, right column |

Various color couplers can be used in the present invention, and examples thereof are described in *Research Disclosure,* RD No. 17643, Sections VII-C-G (including specific references referred to therein). As dye-forming couplers, couplers which can develop primary colors in the subtractive color process, that is, yellow, magenta and cyan couplers, are important and examples of non-diffusible hydrophobic 4-equivalent or 2-equivalent couplers are described in references cited in *Research Disclosure,* RD No. 17643, Sections VII C and D. In addition to these couplers, the following couplers can also be preferably used in the present invention.

Typical examples of yellow couplers that can be used in the present invention are hydrophobic acylacetamido type couplers having a ballast group. Examples of such couplers are described in U.S. Pat. Nos. 2,407,210, 2,875,057 and 3,265,506, etc. For the present invention, 2-equivalent yellow couplers are preferred, and typical examples thereof are oxygen atom leaving type yellow couplers described in U.S. Pat. Nos. 3,408,194, 3,447,928, 3,933,501 and 4,022,620, etc., and nitrogen atom leaving type yellow couplers described in Japanese Patent Publication No. 10739/83, U.S. Pat. Nos. 4,401,752 and 4,326,024, *Research Disclosure,* RD No. 18053 (April 1979), British Patent No. 1,425,020, German Offenlegungsschriften Nos. 2,219,917, 2,261,361, 2,329,587 and 2,433,812, etc. α-Pivaloylacetanilide type couplers are excellent in fastness of the developed dyes, particularly fastness to light, and on the other hand, α-benzoylacetanilide couplers also exhibit a high developed color density.

Magenta couplers that can be used in the present invention, in addition to these described in detail above, include indazolone type couplers or cyanoacetyl type couplers, in particular, 5-pyrazolone type couplers, which have a ballast group and are hydrophobic. Of these 5-pyrazolone type couplers, couplers wherein the 3-position is substituted by an arylamino group or an acylamino group are preferred in view of the hue of the developed color dye and the developed color density, and typical examples thereof are described in U.S. Pat. Nos. 2,311,082, 2,343,703, 2,600,788, 2,908,573, 3,062,653, 3,152,896 and 3,936,015, etc. Groups capable of being cleaved from 2-equivalent 5-pyrazolone type couplers are particularly preferred to be nitrogen atom leaving groups as described in U.S. Pat. No. 4,310,619, and arylthio groups described in U.S. Pat. No. 4,351,897. 5-Pyrazolone type couplers having a ballast group described in European Patent No. 73,636 result in a high developed color density.

Cyan couplers that can be used in the present invention include hydrophobic non-diffusible naphthole type and phenol type couplers, and typical examples thereof are 2-equivalent naphthole couplers having an oxygen atom leaving group, as described in U.S. Pat. Nos. 4,052,212, 4,146,396, 4,228,233 and 4,296,200. Examples of the phenol type couplers are described in U.S. Pat. Nos. 2,369,929, 2,801,171, 2,772,162 and 2,895,826.

Cyan couplers that are fast to humidity and temperature are preferably used in the present invention, and typical examples of these cyan couplers include phenol type cyan couplers having an alkyl group comprising 3 or more carbon atoms at the meta-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Offenlegungsschrift No. 3,329,729 and European Patent No. 121,365, phenol type couplers having a phenylureido group at the 2-position and an acylamino group at the 5-position as described in U.S. Pat. Nos. 3,446,622, 4,333,999, 4,451,559 and 4,427,767, etc.

Couplers whose developed color dyes have a suitable diffusibility can be used additionally to improve the graininess. Examples of such couplers are the magenta couplers described in U.S. Pat. No. 4,366,237 and British Patent No. 2,125,570 and yellow, and the magenta or cyan couplers described in European Patent No. 96,570 and West German Offenlegungsschift No. 3,234,533.

Dye-forming couplers and the above-mentioned specific couplers may be in the form of a dimer or higher polymer. Specific examples of polymerized dye-forming couplers are described in U.S. Pat. Nos. 3,451,820 and 4,080,211. Examples of polymerized magenta couplers are described in British Patent No. 2,102,173 and U.S. Pat. No. 4,367,282.

Couplers that will release a photographically useful residue group upon a coupling reaction can also be used in the present invention. For example, couplers known as development inhibitor-releasing ("DIR") couplers, and couplers described in *Research Disclosure,* RD NO. 17643, Section VII-F, are useful.

Other couplers that can also be used in combination with the present invention include developing solution inactivating type couplers as described in Japanese Patent Application (OPI) Nos. 151944/82, timing type couplers as described in U.S. Pat. No. 4,248,962 and Japanese Patent Application (OPI) No. 154234/82, and reactive type couplers as described in Japanese Patent Application (OPI) No. 184248/85. Particularly preferred couplers are developing solution inactivating type DIR couplers as described in Japanese Patent Application (OPI) Nos. 151944/82, 217932/83, 218644/85, 225156/85, and 233650/85, etc. and reactive type DIR couplers described in Japanese Patent Application (OPI) No. 39653/84, etc.

Couplers contemplated for use in the present invention can be introduced into a photosensitive material by various known methods, for example, by the solid dispersion method, the alkali dispersion method, the latex dispersion method, the oil-in-water dispersion method, etc. The latex dispersion method s preferred, while the oil-in-water dispersion method is even more preferred. In the oil-in-water dispersion method, a coupler is dissolved in a high boiling point organic solvent having a boiling point of about 175° C. or more, or a co-solvent having a low boiling point, or a mixture thereof, and the solution is finely dispersed into water or an aqueous medium such as an aqueous, gelatin solution in the presence of a surface active agent. Examples of the high boiling point organic solvents are described in U.S. Pat. No. 2,322,027. The dispersion may be accompanied by the phase reversal of the emulsion, and if required, the cosolvent is removed or decreased by distillation, Nudel water washing method or ultrafiltration and the emulsion may then be used.

The magenta couplers of general formula (I) used in the present invention are preferably added into a photosensitive material using above mentioned high-boiling solvent through a conventional oil-in-water dispersion method. The weight ratio of the high-boiling solvent to the magenta coupler is desirably 0 to 6.0.

The steps and effect of the latex dispersion method and examples of latexes for impregnation are described in U.S. Pat. No. 4,199,363 and West German Patent Application (OLS) Nos. 2,541,274 and 2,541,230.

A photosensitive material of the present invention may contain, as a color fog preventive agent or a color mixing preventing agent, hydroquinone derivatives, aminophenol derivatives, amines, gallic acid derivatives, catechol derivatives, ascorbic acid derivatives, colorless couplers, sulfonamidophenol derivatives, etc.

The present photosensitive material can further employ various discoloration preventive agents. Examples of organic discoloration preventive agents include hydroquinones, 6-hydroxychromans, 5-hydroxycoumarans, spirochromans, p-alkoxyphenols, hindered phenols such as hindered bisphenols, gallic acid derivatives, methyleneoxybenzenes, aminophenols, hindered amines, and ether or ester derivatives obtained by the silylation or alkylation of the phenolic hydroxyl group of these compounds. Metal complexes such as a (bis-N,N-dialkyldithiocarbamato)nickel complex and a (bisalicylaldoxymato)nickel complex can also be used.

The present invention can also be applied to a multilayer, multicolor photographic material having at least two different spectral sensitivities on a substrate. A multilayer color photographic material generally comprises a substrate having provided thereon at least each of a red sensitive emulsion layer, a green sensitive emulsion layer and a blue sensitive emulsion layer. The order of these layers are selected based on the desired effects by the skilled artism. A preferred order of these layers is a red sensitive emulsion layer, a green sensitive emulsion layer and a blue sensitive emulsion layer coated outward from the substrate or a blue sensitive emulsion layer, a red sensitive emulsion layer and a green sensitive emulsion layer coated outward from the substrate. Each emulsion layer may comprise two or more emulsion layers having different sensitivities, and a nonphotosensitive layer may exist between emulsion layers having the same sensitivity. Although generally a red sensitive emulsion layer contains a cyan forming coupler, a green sensitive emulsion layer contains a magenta forming coupler and a blue sensitive emulsion layer contains a yellow forming coupler, these combinations can be varied in some cases.

It is preferred that the present photosensitive material is provided, in addition to the silver halide emulsion layer, with auxiliary layers such as a protective layer, an intermediate layer, a filter layer, an antihalation coating, a back layer, etc.

In the present photosensitive material, the photographic emulsion layer and other layers are applied on a flexible substrate generally used for photosensitive materials such as plastic film, paper and fabric, or on a rigid substrate generally used for photosensitive materials such as glass, ceramic and metal. Useful flexible substrates are films made of cellulose derivatives (e.g., cellulose nitrates, cellulose acetates, and cellulose acetate butyrates) or synthetic high molecular weight polymers (e.g., polystyrenes, polyvinyl chlorides, polyethylene terephthalates and polycarbonates), papers or the like coated or laminated with a baryta layer or α-olefin polymer (e.g., polyethylenes, polypropylenes and ethylene/butene copolymers). The substrate may be colored with a dye or a pigment and may be blackened for the purpose of screening light. The surface of the substrate is generally subjected to primer coating treatment so as to improve the adhesion to the photographic emulsion layer and other layers. Before or after the primer coating treatment, the substrate surface may be subjected to a treatment such as glow discharge treatment, corona discharge treatment, ultraviolet irradiation treatment, flame treatment, etc.

The application of the photographic emulsions and other hydrophilic colloidal layers can be carried out by using any one of the various known methods, for example, dip coating, roller coating, curtain coating, extrusion coating, etc. If required, a plurality of layers may be applied simultaneously by one of the coating methods described in U.S. Pat. Nos. 2,681,294, 2,761,791, 3,526,528and 3,508,947, etc.

The color photosensitive material according to the present invention can be subjected to developing treatment by a conventional method as described in the above-cited Research Disclosure, RD No. 17643, pages 28–29 and ibid., RD No. 18716, page 651. The present color photosensitive material is generally subjected to water washing treatment or stabilizing treatment after the developing treatment, as well as bleach-fix treatment or fixing treatment.

The water washing step is generally carried out in such a manner that two or more tanks are arranged and counterflow washing is used to save water. As a stabilizing treatment, instead of a water washing step, a multi-counter-flow stabilizing treatment as described in Japanese Patent Application (OPI) No. 8543/82 can be employed. In this step, 2 to 9 counterflow baths are required. Into these stabilizing baths, various compounds are added to stabilize the image. Typical examples of such compounds include various buffers for adjusting the film pH to, for example, 3 to 8, such as a combination of borates, metaborates, borax, phosphates, carbonates, potassium hydroxide, sodium hydroxide, ammonia water, monocarboxylic acids, dicarboxylic acids, polycarboxylic acids, etc., and formaldehyde. Additionally, if desired, various additives can be added such as a water softener (e.g., inorganic phosphoric acids, aminopolycarboxylic acids, organic phosphoric acids, aminopolyphosphonic acids, phosphonocarboxylic acids, etc.), a fungicide (e.g., benzoisothiazolinones, irithiazolones, 4-thiazolinebenzimidazoles, haloganated phenols, etc.), a surface active agent, a brightening agent, a hardening agent, etc., and these additives may also be used in combination.

After this treatment, ammonium salts are preferred to be added as film pH adjusting agents, such as ammonium chloride, ammonium nitrate, ammonium sulfate, ammonium phosphate, ammonium sulfite, ammonium thiosulfate, etc.

The present invention can be applied to various color photosensitive materials. Typical examples of such color photosensitive materials are general-purpose or motion picture color negative films, color reversal films for slides or television, color papers, color positive films, color reversal papers, etc. The present invention can also be applied to black and white photosensitive materials using three-color coupler mixing as described in *Research Disclosure,* RD No. 17123 (July 1978).

The present invention is particularly preferred to be applied to photosensitive materials for direct observation such as color papers, color positive films, color reversal films, color reversal papers, etc.

The present invention is further illustrated in detail by the following examples, though the invention is not intended to be limited to these examples. Unless otherwise indicated, all parts, percents, ratios and the like are by weight.

EXAMPLE 1

A color photosensitive material was prepared by successively coating a paper substrate, whose opposite surface had been laminated with polyethylene, with the following first to eleventh layers. The polyethylene on the opposite side of the substrate included titanium white as white pigment and a trace amount of ultramarine as a bluish dye.

Photosensitive layer compositions

The components and the applied amounts in g/m$^2$ are shown below. The applied amounts of the silver halide is given in terms of silver. The specific compounds used are listed after the description of layer composition.

| | |
|---|---|
| First layer (antihalation layer): | |
| Block collaoidal silver | 0.10 |
| Gelatin | 2.0 |
| Second layer (low sensitivity red senstitive layer): | |
| Silver bromoiodide emulsion (silver iodide: 3.5 mol %, average grain size: 0.7 μm) spectrally sensitized with red sensitizing dyes (*5 and *4) | 0.15 |
| Gelatin | 1.0 |
| Cyan couple (*3) | 0.30 |
| Discoloration preventive agent (*2) | 0.15 |
| Coupler solvents (*18 and *1) | 0.06 |
| Third layer (high sensitivity red sensitive layer): | |
| Silver bromoiodide emulsion (silver iodide: 8.0 mol %, average grain size: 0.7 μm) spectrally sensitized with red sensitizing dyes (*5 and *4) | 0.10 |
| Gelatin | 0.50 |
| Cyan coupler (*3) | 0.10 |
| Discoloration preventive agent (*2) | 0.05 |
| Coupler solvents (*18 and *1) | 0.02 |
| Fourth layer (intermediate layer): | |
| Yellow colloidal silver | 0.02 |
| Gelatin | 1.00 |
| Color mixing preventive agent (*14) | 0.08 |
| Solvent for color mixing preventive agent (*13) | 0.16 |
| Polymer latex (*6) | 0.10 |
| Fifth layer (low sensitivity green sensitive layer): | |
| Silver bromoiodide emulsion (silver iodide: 2.5 mol %, average grain size: 0.4 μm) spectrally sensitized with green sensitizing dye (*12) | 0.20 |
| Gelatin | 0.70 |
| Magenta coupler (*11) | 0.40 |
| Discoloration preventive agent A (*10) | 0.05 |
| Discoloration preventive agent B (*9) | 0.05 |
| Discoloration preventive agent C (*8) | 0.02 |
| Coupler solvent (*7) | 0.15 |
| Sixth layer (high sensitivity green sensitive layer): | |
| Silver bromoiodide emulsion (silver iodide: 3.5 mol %, average grain size: 0.9 μm) spectrally sensitized with green sensitizing dye (*12) | 0.20 |
| Gelatin | 0.70 |
| Magenta coupler (*11) | 0.40 |
| Discoloration preventive agent A (*10) | 0.05 |
| Discoloration preventive agent B (*9) | 0.05 |
| Discoloration preventive agent C (*8) | 0.02 |
| Coupler solvent (*7) | 0.15 |
| Seventh layer (yellow filter layer): | |
| Yellow colloidal silver | 0.20 |
| Gelatin | 1.00 |
| Color mixing preventive agent (*14) | 0.06 |
| Solvent for color mixing preventive agent (*13) | 0.24 |
| Irradiation preventive dyes (*23) and (*24) | 0.05<br>0.07 |
| Eighth layer (low sensitivity blue sensitive layer): | |
| Silver bromoiodide emulsion (silver iodide: 2.5 mol %, average grain size: 0.5 μm) spectrally sensitized with blue sensitizing dye (*16) | 0.15 |
| Gelatin | 0.50 |
| Yellow coupler (*15) | 0.20 |
| Coupler solvent (*18) | 0.05 |
| Ninth layer (high sensitivity blue sensitive layer): | |
| Silver bromoidide emulsion (silver iodide: 2.5 mol %, average grain size: 1.4 μm) spectrally sensitized with blue sensitizing dye (*16) | 0.20 |
| Gelatin | 0.50 |
| Yellow coupler (*15) | 0.20 |
| Coupler solvent (*18) | 0.05 |
| Tenth layer (ultraviolet absorbing layer): | |
| Gelatin | 1.50 |
| Ultraviolet absorbing agent (*19) | 1.0 |
| Solvent for ultraviolet absorbing agent (*18) | 0.30 |
| Color mixing preventive agent (*17) | 0.08 |
| Eleventh layer (protective layer): | |
| Finely divided silver chlorobromide (silver chloride: 77 mol %, average grain size: 0.2 μm) | 0.07 |
| Gelatin | 1.0 |

-continued

| | |
|---|---|
| Hardening agent (*20) | 0.17 |

Note:
*1: dioctyl phthalate
*2: 2-(2-hyldroxy-3-sec-butyl-5-t-butylphenyl)benzotriazole
*3: 2-[α-(2,4-di-t-amylphenoxy)butaneamido]-4,6-dichloro-5-methylphenol
*4: 5,5'-dichloro-3,3'-di(3-sulfobutyl)-9-ethylthia-carbocyanine sodium salt
*5: triethylammonium-3-[2-{2-[3-(3-sulfopropyl)-naphtho(1,2-d)thiazolin-2-ylidenemethyl]-1-butenyl}-3-naphtho(1,2-d)thiazolino]propane sulfonate
*6: poly(ethyl acrylate)
*7: trioctyl phosphate
*8: 2.4-di-t-hexylhydroquinone
*9: di-(2-hydroxy-3-t-butyl-5-methylphenyl)methane
*10: 3,3,3',3'-tetramethyl-5,6,5',6'-tetrapropoxy-1,1'-bisspiroindane
*11: 1-(2,4,6-trichlorophenyl)-3-(2-chloro-5-tetradecaneamino)anilino-2-pyrazolin-5-one
*12: 5,5'-diphenyl-9-ethyl-3,3'disulfopropyloxacarboxyaniline sodium salt
*13: o-cresyl phosphate ester
*14: 2,4-di-t-octylhydroquinone
*15: α-pivaloyl-α-[(2,4-dioxo-1-benzyl-5-ethoxy-hydantoin-3-yl)-2-chloro-5-(α-2,4-dioxo-5-amyl-phenoxy)butaneamino]acetanilide
*16: triethylammonium 3-[2-(3-benzylrhodanin-5-ylidene)-3-benzoxazolinyl]propane sulfonate
*17: 2,4-di-sec-octylhydroquinone
*18: trinonyl phosphate
*19: 5-chloro-2-(2-hydroxy-3-t-butyl-5-t-butyl-5-t-octyl)phenyl-benzotriazole
*20: 1,4-bis(vinylsulfonylacetamido)ethane
*21: 2,[α-(2,4-di-t-amylphenoxy)butaneamido-4,6-dichloro-5-ethylphenol
*22: 4-chloro-2-(2-chlorobenzamido)-5-[α-4-t-amyl-2-chlorophenoxy)octaniamido]-phenol
*23

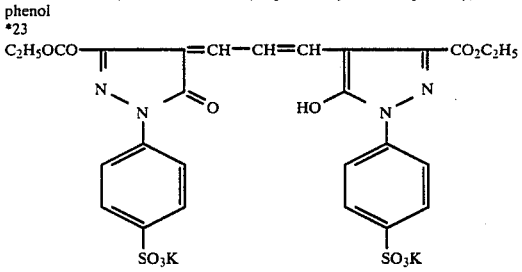

*24

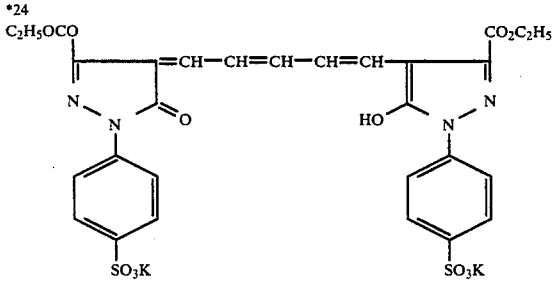

The sample prepared as above was named Sample No. 101 and was used as a control.

Instead of the magenta coupler (*1) in the fifth layer and the sixth layer of Sample No. 101, M-5 was used and the applied amount of the silver was halved to prepare Sample No. 102, and in Sample No. 103, compound II-13 was added further into sixth layer of Sample No. 102.

In Sample No. 104, instead of cyan coupler (*3) in the second layer and the third layer of Sample No. 101, cyan couplers *21 and *22 were used in equimolar amounts (*21/*22 molar ratio=7/3).

These Samples were subjected to wedge exposure for sensitometry and were then developed using the following treatment steps. The results are shown in Table 2.

| Treatment steps | |
|---|---|
| First development (black and development) | 38° C., 1 minute 15 seconds |
| Water washing | 38° C., 1 minute 30 seconds |
| Reversal exposure | 100 lux or more, 1 minute or more |
| Color development | 38° C., 2 minutes 15 seconds |
| Water washing | 38° C., 45 seconds |
| Bleach-fixing | 38° C., 2 minutes 00 second |
| Water washing | 38° C., 2 minutes 15 seconds |

| Treatment liquid compositions | |
|---|---|
| First developing solution | |
| Pentasodium salt of nitrilo-N,N,N-trimethylenephosphonate | 0.6 g |
| Pentasodium salt of diethylenetriamine-tetraacetate | 4.0 g |
| Potassium sulfite | 30.0 g |
| Potassium thiocyanate | 1.2 g |
| Potassium carbonate | 35.0 g |
| Hydroquinonemonosulfonate potassium salt | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make | 1 liter solution (pH: 9.70) |
| Color developing solution | |
| Benzyl alcohol | 15.0 ml |
| Diethylene glycol | 12.0 ml |
| 3,6-Dithia-1,8-octanediol | 0.2 g |
| Pentasodium salt of nitrilo-N,N,N-trimethylenephosphonate | 0.5 g |
| Pentasodium salt of diethylenetriamine-tetraacetate | 2.0 g |
| Sodium sulfite | 2.0 g |
| Potassium carbonate | 25.0 g |
| Hydroxylamine sulfate | 3.0 g |
| N-ethyl-N-(β-methanesulfonamidoethyl)-3-methyl-4-aminoaniline sulfate | 5.0 g |
| Potassium bromide | 0.5 g |
| Potassium iodide | 1.0 mg |
| Water to make | 1 liter solution (pH: 10.40) |
| Bleach-fix bath | |
| 2-mercapto-1,3,4-triazole | 1.0 g |
| Disodium salt dihydrate of ethylenediaminetetraacetic acid | 5.0 g |
| Ethylenediaminetetraacetic acid Fe (III) ammonium nonhydrate | 80.0 g |
| Sodium sulfite | 15.0 g |
| Sodium thiosulfate (700 g/l solution) | 160.0 mg |
| Glacial acetic acid | 5.0 ml |
| Water to make | 1 liter solution (pH: 6.50) |

TABLE 2

| Sample No. | Magenta Coupler (the fifth and sixth layers) | Mercapto-Tetrazole Additive (the 6th layer) | Color Purity of magenta ($D_R + D_B/D_G$) | Sensitivity after 3 months at 35° C. and a relative humidity at 55%, assuming the sensitivity before the lapse of time as 100 | Dye image self stability at 60° C., 70% stain image ($\Delta D_B$) after 6 weeks |
|---|---|---|---|---|---|
| 101 (Comparative Example) | *11 | — | 0.475 | 84 | 0.16 |
| 102 (Comparative Example) | M-5 | — | 0.165 | 79 | 0.04 |

TABLE 2-continued

| Sample No. | Magenta Coupler (the fifth and sixth layers) | Mercapto-Tetrazole Additive (the 6th layer) | Color Purity of magenta ($D_R + D_B/D_G$) | Sensitivity after 3 months at 35° C. and a relative humidity at 55%, assuming the sensitivity before the lapse of time as 100 | Dye image self stability at 60° C., 70% stain image ($\Delta D_B$) after 6 weeks |
|---|---|---|---|---|---|
| 103 (Present Invention) | M-5 | II-13 | 0.165 | 93 | 0.03 |
| 104 (Present Invention) | M-5 | II-13 | 0.163 | 94 | 0.02 |

The term "color purity of magenta" used herein means the ratio of $D_G$ to the sum of $D_R$ and $D_B$ in magenta color wherein $D_G$ is 1.0 according to a Macbeth Densitometer Status AA filter. The sample was wedge exposed by additionally using a magenta filter CC 100M (produced by Fuji PHoto Film Co., Ltd.) and $D_R$ and $D_B$ were measured at the point where $D_G$ is 1.0. In other words, the color purity of magenta is a scale indicating the amounts of excess cyan and yellow constituents in magenta color, and therefore, in general, the lower the value of the color purity of magenta, the higher the purity of the color.

As understood from Table 2, the samples according to the present invention (103 and 104) are high in color purity and superior in long-term shelf stability over the comparative samples (101 and 102).

EXAMPLE 2

A paper substrate whose composite surface has been laminated with polyethylene was coated with successive photosensitive layers comprising the following first to third layers to prepare a color photosensitive material. The polyethylene layer included titanium white as white pigment and a trace amount of ultramarine as bluish dye.

Photosensitive layer constitution

The applied amounts of the components are given in g/m² and the amount of the silver halide is given in terms of silver.

| | |
|---|---|
| First layer (green layer): | |
| Silver chlorobromide emulsion (silver bromide: 70 mol %, sensitizing dye: (*1) | 0.30 |
| Magenta coupler (*2) | 0.25 |
| Magenta couple solvent (*6) | 0.30 |
| Discoloration preventive agent (*3/*4) | 0.05/ 0.10 |
| Gelatin | 1.00 |
| Second layer (ultraviolet absorbing intermediate layer): | |
| Ultraviolet absorbing agent (*5) | 0.70 |
| Ultraviolet abosrbing agent (DBP) | 0.20 |
| Gelatin | 0.15 |
| Third layer (protective layer): | |

-continued

| | |
|---|---|
| Getatin | 1.5 |

Note:
DBP represents a debutylphthalate.
Other compounds noted above as *1 to *6 used in these layers are shown below:

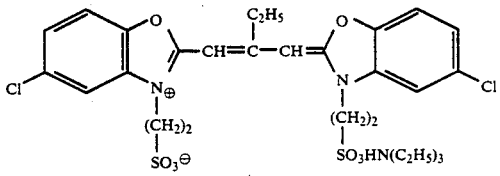

*2

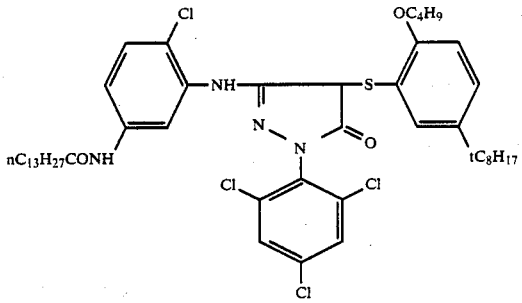

*3

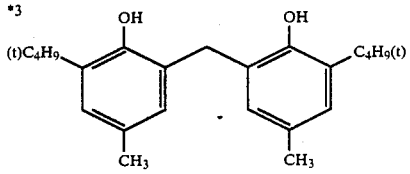

*4

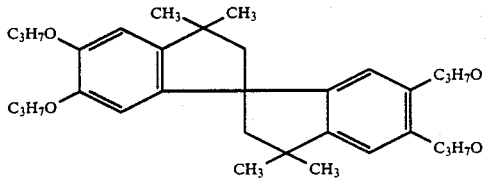

*5

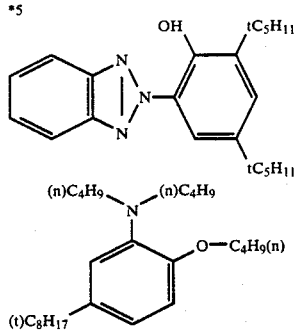

The thus-obtained photosensitive material was named Sample 201.

and yellow filters and a self-recording densitometer. The results are shown in Table 3.

TABLE 3

| Sample No. | Coupler in the first layer/ dispersing oil | Applied amount | Mercapto tetrazole additive in the first layer | Applied amount | Relative humidity (%) during storage | Color purity $D_R + D_B/D_G = 2.0$ | Sensitivity after storage (2 months, at 35° C.), assuming the sinsitivity before the storage as 100 |
|---|---|---|---|---|---|---|---|
| 201 (Comparative Example) | *2/*6 | 0.25 g | — | — | 68 | 0.424 | 88 |
| 202 (Comparative Example) | " | " | — | — | 55 | " | 89 |
| 203 (Comparative Example) | " | " | II-13 | 0.30 | 68 | " | 92 |
| 204 (Comparative Example) | " | " | " | 0.30 | 55 | " | 94 |
| 205 (Comparative Example) | M-5/TOP | 0.30 g | — | — | 68 | 0.147 | 64 |
| 206 (Comparative Example) | " | " | — | — | 55 | " | 70 |
| 207 (Present Invention) | " | " | II-13 | 0.30 | 68 | " | 88 |
| 208 (Present Invention) | " | " | " | 0.30 | 60 | " | 93 |
| 209 (Present Invention) | " | " | " | " | 55 | " | 94 |
| 210 (Present Invention) | " | " | " | " | 45 | " | 94 |

Samples 202 to 210 were prepared in a similar way to that for Sample 201 except that certain changes were made as shown in Table 3 below. These Samples were subjected to wedge exposure for sensitometry using an enlarger (Fuji Color Head 609 produced by Fuji Photo Film Co., Ltd.), and were developed in accordance with the following steps.

| | Treatment steps | |
|---|---|---|
| | Temperature | Time |
| Developing | 33° C. | 3.5 min |
| Bleach-fixing | 33° C. | 1.5 min |
| Water washing | 28–35° C. | 3.0 min |

| Developing solution | |
|---|---|
| Trisodium salt of nitrilotriacetate | 2.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-[β-(methanesulfonamido)ethyl]-p-phenylenediamine sulfate | 5.0 g |
| $Na_2CO_3$ monohydrate | 30 g |
| Water to make | 1 liter solution (pH: 10.1) |
| **Bleach-fixing bath** | |
| Ammonium thiosulfate (70 wt %) | 150 ml |
| $Na_2SO_3$ | 15 g |
| $NH_4[Fe(EDTA)]$ | 55 g |
| $EDTA_2$ 2Na | 4 g |
| Water to make | 1 liter solution |

After the above treatments, the characteristic curves (D-log E curve) were determined by using blue, green The term "color purity ($D_R+D_B/D_G$ (2.0))" used herein and in Table 3 means the ratio of the density of magenta ($D_G$) to the sum of the density of cyan ($D_R$) and the density of yellow ($D_B$) in magenta color wherein $D_G$ is 2.0 according to a Macbeth Densitometer Status AA filter. In other words, the color purity indicates the ratio of the excess cyan and yellow constituents in magneta color, and therefore, generally speaking, the lower the value of the color purity, the higher the purity of the magenta color.

As is understood from Table 3, the samples (207–210) according to the present invention are superior over the comparative samples in view of color purity and long-term shelf stability as a whole.

EXAMPLE 3

A triacetate film base was successively coated with the following first to thirteenth layers to prepare a sample 301.

First layer (antihalation layer)

An emulsified material (a) that was prepared by stirring at high speed: 15 g of ultraviolet absorbing agents, 5-chloro-2-(2-hydroxy-3,5-di-t-butylphenyl)-2H-benzotriazole, 30 g of 2-(2-hydroxy-5-t-butylphenyl)-2H-benzotriazole, 35 g of 2-(2-hydroxy-3-sec-butyl-5-t-butylphenyl)-2H-benzotriazole, 100 g of dodecyl-5-(N,N-diethylamino)-2-benzenesulfonyl-2,4-pentadienoate, 200 ml of tricresylphospheto, 100 ml of ethyl acetate, 20 g of sodium dodecylbenzene sulfate, and a 10% aqueous gelatin solution. This material (a) was then mixed with 10% gelatin, black colloidal silver, water and an application aid, and the resulting mixture was applied so that the dried film thickness was 2 μm.

Second layer (gelatin intermediate layer)

2 kg of an emulsified material (b) that was obtained by stirring at high speed: 2,5-di-t-octylhydroquinone dissolved in 100 cc of dibutylphthalate, 100 cc of ethyl acetate and 1 kg of a 10% aqueous gelatin solution. This material (b) was then mixed with 1.5 kg of 10% aqueous gelatin solution, and the resulting mixture was applied so that the dry film thickness was 1 μm.

Third layer (low sensitivity red sensitive emulsion layer)

500 g of an emulsified material (c) that was obtained by stirring at high speed: 100 g of cyan coupler 2-(haptafluorobutylamido)-5-{2',2'',4''-di-t-aminophenoxy)-butylamido}-phenol dissolved in 100 cc of tricresylphosphate, 100 cc of ethyl acetate and 1 kg of a 10% aqueous gelatin solution. This material (c) was then mixed with 1 kg of a red sensitive silver bromoiodide emulsion that contained 70 g of silver, 60 g of gelatin and had an iodine content of 4 mol%, and the resulting mixture was applied so that the dry film thickness was 1 μm (0.5 g f silver/$m^2$).

Fourth layer (high sensitivity red sensitive emulsion layer)

The emulsified material (c) was mixed with 1 kg of a red sensitive silver bromoiodide emulsion that contained 70 g of silver, 60 g of gelatin and had an iodine content of 2.5 mol% and the resulting mixture was applied so that the dry film thickness was 2.5 μm (0.8 g of silver/$m^2$).

Fifth layer (intermediate layer)

1 kg of the emulsified material (b) was mixed with 1 kg of 10% aqueous gelatin solution and the resulting mixture was applied so that the dry film thickness was 1 μm.

Sixth layer (low sensitivity green sensitive emulsion layer)

300 g of an emulsified material (d) that was obtained in the same way as described above for the emulsified material in the third layer except that instead of the cyan coupler, magenta coupler, 1-(2,4,6-trichlorophenyl)-3-{3-(2,4-di-t-amylphenoxyacetamido)benzamido}-5-pyrazolone was employed. This material was then mixed with 1 kg of a green sensitive silver bromoiodide emulsion that contained 70 g of silver, 60 g of gelatin and had an iodine content of 3 mol%, and the mixture was applied so that the dry film thickness was 2.0 μm (0.7 g of silver/$m^2$).

Seventh layer (high sensitivity green sensitive emulsion layer)

1000 g of the emulsified material (d) were mixed with 1 kg of a green sensitive silver bromoiodide emulsion that contained 70 g of silver, 60 g of gelatin and had an iodine content of 2.5 mol% and the mixture was applied so that the dry film thickness was 2.0 μm (0.7 g of silver/$m^2$).

Eighth layer (gelatin intermediate layer)

1 kg of the emulsified material (b) was mixed with 1 kg of a 10% aqueous gelatin solution, and the mixture was applied so that the dry film thickness was 0.5 μm.

Ninth layer (yellow filter layer)

An emulsion containing yellow colloidal silver was applied so that the dry film thickness was 1 μm.

Tenth layer (low sensitivity blue sensitivity emulsion layer)

1000 g of an emulsified material (e) that was obtained in the same way as described above for the emulsified material in the third layer except that instead of the cyan coupler, a yellow coupler, α-(pivaloyl)-α-(1-benzyl-5-ethoxy-3-hydantoinyl)-2-chloro-5-dodecyloxycarbonylacetanilide, was used. This material (e) was then mixed with 1 kg of a blue sensitive silver bromoiodide emulsion that contained 70 g of silver, 60 g of gelatin and had an iodine content of 2.5 mol% and the resulting mixture was applied so that the dry film thickness was 1.5 μm (0.6 g of silver/$m^2$).

Eleventh layer (high sensitive blue sensitivity emulsion layer)

1000 g of the emulsified material (e) were mixed with 1 kg of a blue sensitive silver bromoiodide emulsion that contained 70 g of silver, 60 g of gelatin and had an iodine content of 2.5 mol%, and the resulting mixture was applied so that the dry film thickness was 3 μm (1.1 g of silver/$m^2$).

Twelfth layer (second protective layer)

The emulsified material (a) was mixed with a 10% aqueous gelatin solution, water and an application aid, and the mixture was applied so that the dry film thickness was 2 μm.

Thirteenth layer (first protective layer)

A 10% aqueous gelatin solution containing a fine grain emulsion, the grain surfaces of which had been fogged, was applied in such a way that the applied amount of silver was 0.1 g/$m^2$ and the dry film thickness was 0.8 μm.

A gelatin hardener, that is, 1,4-bis(vinylsulfonylacetamido)ethane, and a surface active agent were added to each layer.

Sample 302 was prepared in the same way as that for Sample 301 except mercaptotetrazole additive II-13 was added to the sixth and seventh layers, and Samples 303 to 306 were prepared in the same way as Sample 301 except that the coupler and the additive were changed as shown in Table 4. Since (M-6) was a two-equivalent coupler, the applied amount of the coupler was accordingly reduced to 60%, and the applied amount of the silver halide was reduced to 70% so that the gradation was regulated to become approximately the same.

These Samples 301 to 306 were subjected to white wedge exposure.

The exposed Samples were developed using the following steps.

| | Treatment steps | |
|---|---|---|
| Step | Time (min.) | Temperature (°C.) |
| First development | 6 | 38 |
| Water washing | 2 | " |
| Reverse | 2 | " |
| Color development | 6 | " |
| Adjustment | 2 | " |
| Bleach | 6 | " |
| Fix | 4 | " |

-continued

| | | |
|---|---|---|
| Water washing | 4 | " |
| Stabilization | 1 | room temperature |
| Drying | | |

The compositions of the treating solutions were as follows:

| | |
|---|---|
| First developing solution | |
| Water | 700 ml |
| Pentasodium salt of nitrilo-N,N,N-trimethylenesulfonic acid | 2 g |
| Sodium sulfite | 20 g |
| Hydroquinone monosulfonate | 30 g |
| Sodium carbonate monohydrate | 30 g |
| 1-Phenyl-4-methyl-4-hydroxylmethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml solution |
| Reversal bath | |
| Water | 700 ml |
| Pentasodium salt of nitrilo-N,N,N-trimethylenesulfonate | 3 g |
| Stannous chloride dihydrate | 1 g |
| p-Aminophenol | 0.1 g |
| Sodium hydroxide | 8 g |
| Glacial acetic acid | 15 ml |
| Water to make | 1000 ml solution |
| Color developing solution | |
| Water | 700 ml |
| Pentasodium salt of nitrilo-N,N,N-trimethylenesulfonate | 3 g |
| Sodium sulfite | 7 g |
| Sodium phosphate dodecahydrate | 36 g |
| Potassium bromide | 1 g |
| Potassium iodide (0.1% solution) | 90 ml |
| Sodium hydroxide | 3 g |
| Citrazinic acid | 1.5 g |
| N-Ethyl-N-(β-methanesulfonamidoethyl)-3-methyl-4-aminoaniline sulfonate | 11 g |
| 3,6-dithiaoctane-1,8-diol | 1 g |
| Water to make | 1000 ml solution |
| Adjusting liquid | |
| Water | 700 ml |
| Sodium sulfite | 12 g |
| Sodium salt dihydrate of ethylene-diaminetetraacetate | 8 g |
| Thioglycerin | 0.4 ml |
| Glacial acetic acid | 3 ml |
| Water to make | 1000 ml solution |
| Bleach bath | |

-continued

| | |
|---|---|
| Water | 800 g |
| Sodium salt dihydrate of ethylene-diaminetetraacetate | 2 g |
| Iron (III) ammonium dihydrate of ethylene-diaminetetraacetate | 120 g |
| Potassium bromide | 100 g |
| Water to make | 1000 ml solution |
| Fixer | |
| Water | 800 ml |
| Sodium thiosulfate | 80.0 g |
| Sodium sulfite | 5.0 g |
| Sodium bisulfite | 5.0 g |
| Water to make | 1000 ml solution |
| Stabilizer | |
| Water | 800 ml |
| Formalin (35 wt %) | 5.0 ml |
| Fuji Driwel (a surface active agent produced by Fuji Photo Film Co., Ltd.) | 5.0 ml |
| Water to make | 1000 ml solution |

The Samples each were introduced into a packaging material, and after storage for two months at 35° C., the same experiments were performed, and measurements similar to Example 1 were carried out to determine the color purity and the lowering of the sensitivity. The results are shown in Table 4.

TABLE 4

| Sample No. | Coupler in the 6th and 7th layers | Additive in the 6th and 7th layers | Humidity (%) during storage | Color purity of magenta | Sensitivity after storage for two months at 35° C., assuming the sensitivity before the storage as 100 |
|---|---|---|---|---|---|
| 301 Comparative Example | as described | — | 68 | 0.421 | 88 |
| 302 Comparative Example | as described | II-13 0.60 mg/m$^2$ | 68 | 0.422 | 93 |
| 303 Comparative Example | M-5 | — | 68 | 0.118 | 77 |
| 304 Present Invention | " | II-13 0.60 mg/m$^2$ | 68 | 0.118 | 91 |
| 305 Present Invention | " | " | 55 | 0.118 | 95 |
| 306 Present Invention | M-3 | " | 55 | 0.118 | 96 |

It would be clear from Table 4 that Sample 304 according to the present invention exhibits particularly good color purity and storability.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material, comprising a support having provided thereon at least one silver halide emulsion layer, and at least one magenta coupler represented by the following general formula (I)

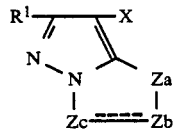

(I)

wherein $R^1$ represents a hydrogen atom or a substituent; X represents a hydrogen atom or a coupling releasing group upon a coupling reaction with the oxidation product of an aromatic primary amine developing agent; Za, Zb and Zc each represents a methine group, a substituted methine group, =N— or —NH—; one of the Za—Zb bond and the Zb—Zc bond is a double bond while the other is a single bond; and Zb—Zc may be fused to an aromatic ring, said coupler may form a dimer or a higher polymer by linking at the $R^1$ or X position, and when Za, Zb or Zc is a substituted methine group, said coupler may form a dimer or a higher polymer through said substituted methine group, and at least one compound represented by the following general formula (II):

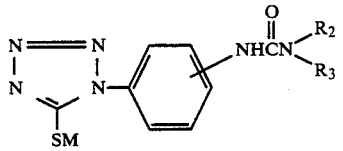

(II)

wherein M represents a hydrogen atom, an alkali metal atom, a quaternary ammonium group or a group that can be cleaved under alkaline conditions; and $R_2$ and $R_3$, which may be the same as or different from each other, represent a hydrogen atom, a substituted or unsubstituted aliphatic hydrocarbon group, or a substituted or unsubstituted aromatic hydrocarbon group, or $R_2$ and $R_3$ may form together a ring, wherein said silver halide color photographic material is in the form of a packaged product and the relative humidity in said package product is up to about 58%.

2. A silver halide color photographic material as claimed in claim 1, wherein said magenta coupler represented by general formula (I) is present in an amount of from about $1\times10^{-3}$ to about $5\times10^{-1}$ per mol of silver halide.

3. A silver halide color photographic material as claimed in claim 1, wherein said compound represented by general formula (II) is present in amount from about $10^{-7}$ to about $10^{-7}$ mol per mol of silver halide.

4. A silver halide color photographic material as claimed in claim 3, wherein said compound represented by general formula (II) is present in an amount from $10^{-5}$ to $10^{-2}$ mol per mol of silver halide.

5. A silver halide color photographic material as claimed in claim 1, wherein said packaged product is a sealed package, and the material comprising said packaged product is selected from the group consisting of aluminum sheet, tin sheet, aluminum foil and composite laminate materials.

6. A silver halide color photographic material as claimed in claim 1, wherein said magenta coupler of the general formula (I) is selected from the group of the compounds of the formulae (III) to (IX),

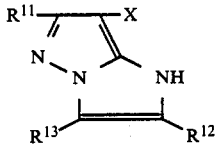

(III)

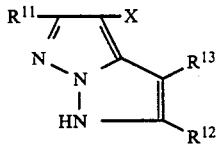

(IV)

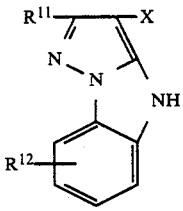

(V)

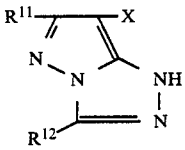

(VI)

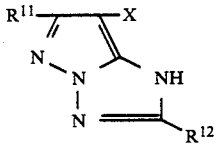

(VII)

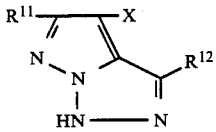

(VIII)

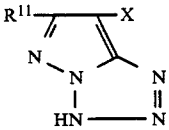

(IX)

wherein $R^{11}$, $R^{12}$ and $R^{13}$ may be the same or different from each other and each represents a hydrogen atom, a halogen atom, an alkyl group, an aryl group, a heterocyclic group, a cyano group, an alkoxy cyano group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoyl amino group, an alkylthio group, an arylthio group, a heterocyclic thio group, an alkoxycarbonylamino group, an aryloxycarbonylamino group, a sulfonamino group, a carbamoyl group, an acyl group, a sulfamoyl group, a sulfonyl group, a sulfinyl group, an alkoxycarbonyl group or an aryloxycarbonyl group; and X represents a hydrogen atom, a halogen atom, a carboxyl group, or a group bonded to the carbon atom at the coupling position via an oxygen atom, a nitrogen atom or a sulfur atom and is capable of being released upon a coupling reaction, and $R^{11}$, $R^{12}$, $R^{13}$ and X may be a divalent group to constitute a bis-form.

7. A silver halide color photographic material as claimed in claim 6, wherein said magenta coupler of the general formula (I) is selected from the group of the compounds of the formulae (III), (VI) and (VII).

8. The silver halide color photographic material as claimed in claim 6, wherein said magenta coupler of the general formula (I) is the compound of the general formula (VII).

9. A silver halide color photographic material as claimed in claim 1, wherein $R_2$ and $R_3$ of the general formula (II) are a hydrogen atom, an alkyl group having 1 to 6 carbon atoms, or a phenyl group.

10. A silver halide color photographic material as claimed in claim 9, wherein $R_2$ and $R_3$ are a hydrogen atom, a methyl group, an ethyl group, an n-propyl group, an n-butyl group or an n-pentyl group.

* * * * *